US007230372B2

(12) United States Patent
Yamamoto et al.

(10) Patent No.: US 7,230,372 B2
(45) Date of Patent: Jun. 12, 2007

(54) ELECTRON-EMITTING DEVICE, ELECTRON SOURCE, IMAGE DISPLAY APPARATUS, AND THEIR MANUFACTURING METHOD

(75) Inventors: Keisuke Yamamoto, Yamato (JP); Tamaki Kobayashi, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/106,636

(22) Filed: Apr. 15, 2005

(65) Prior Publication Data

US 2005/0236965 A1 Oct. 27, 2005

(30) Foreign Application Priority Data

Apr. 23, 2004 (JP) ..... 2004-127646

(51) Int. Cl.
*H01J 19/06* (2006.01)

(52) U.S. Cl. ..... 313/311; 313/495

(58) Field of Classification Search ..... 313/293–304, 313/495–497, 309–310, 306, 336, 351; 445/24, 445/50, 51, 25
See application file for complete search history.

(56) References Cited

U.S. PATENT DOCUMENTS

| | | | | |
|---|---|---|---|---|
| 5,847,495 | A | 12/1998 | Yamanobe et al. | 313/310 |
| 6,147,449 | A | 11/2000 | Iwasaki et al. | 313/495 |
| 6,171,162 | B1 | 1/2001 | Iwasaki et al. | 445/6 |
| 6,179,678 | B1 | 1/2001 | Kishi et al. | 445/24 |
| 6,184,610 | B1 | 2/2001 | Shibata et al. | 313/309 |
| 6,225,749 | B1 | 5/2001 | Kobayashi et al. | 315/169.3 |
| 6,246,168 | B1 | 6/2001 | Kishi et al. | 313/495 |
| 6,267,636 | B1 | 7/2001 | Onishi et al. | 445/6 |
| 6,334,801 | B1 | 1/2002 | Kawade et al. | 445/24 |
| 6,379,211 | B2 | 4/2002 | Onishi et al. | 445/73 |
| 6,380,665 | B1 | 4/2002 | Motoi et al. | 313/310 |
| 6,409,563 | B1 | 6/2002 | Tamura et al. | 445/3 |
| 6,608,437 | B1 | 8/2003 | Kishi et al. | 313/495 |
| 6,617,773 | B1 | 9/2003 | Yamamoto et al. | 313/310 |
| 6,626,719 | B2 | 9/2003 | Ono et al. | 445/24 |
| 6,633,118 | B1 | 10/2003 | Yamamoto et al. | 313/495 |
| 6,642,649 | B1 | 11/2003 | Yamamoto et al. | 313/495 |
| 6,726,520 | B2 | 4/2004 | Takeda et al. | 445/62 |
| 6,731,060 | B1 | 5/2004 | Yamamoto et al. | 313/495 |
| 6,802,753 | B1 | 10/2004 | Ando et al. | 445/6 |
| 6,831,401 | B1 | 12/2004 | Yamamoto et al. | 313/495 |
| 6,849,999 | B1 | 2/2005 | Kobayashi et al. | 313/495 |

(Continued)

FOREIGN PATENT DOCUMENTS

EP 1 324 366 A2 7/2003

(Continued)

*Primary Examiner*—Nimeshkumar D. Patel
*Assistant Examiner*—Anthony Canning
(74) *Attorney, Agent, or Firm*—Fitzpatrick, Cella, Harper & Scinto

(57) ABSTRACT

In an electron-emitting device having a pair of electroconductors arranged on a substrate at an interval, a top of one electroconductor is higher than that of the other electroconductor and a groove extending from the interval region toward a position under a region where the one electroconductor is come into contact with the substrate is formed on the substrate. Deterioration of the electron-emitting device due to collision of charged particles is suppressed by the asymmetrical electron-emitting region, electron-emitting efficiency is improved, and a long life is realized.

9 Claims, 12 Drawing Sheets

U.S. PATENT DOCUMENTS

| | | | | |
|---|---|---|---|---|
| 6,876,156 | B1 | 4/2005 | Yamamoto et al. | 315/169.3 |
| 6,888,296 | B2 | 5/2005 | Motoi et al. | 313/310 |
| 2002/0068496 | A1 | 6/2002 | Onishi et al. | 445/6 |
| 2002/0117670 | A1 | 8/2002 | Horiguchi et al. | 257/59 |
| 2003/0104751 | A1* | 6/2003 | Jindai et al. | 445/6 |
| 2003/0222570 | A1 | 12/2003 | Kishi et al. | 313/495 |
| 2005/0035703 | A1 | 2/2005 | Yamamoto et al. | 313/495 |
| 2005/0040751 | A1 | 2/2005 | Yamamoto et al. | 313/311 |
| 2005/0194912 | A1 | 9/2005 | Kobayashi et al. | 315/169.1 |
| 2005/0225230 | A1 | 10/2005 | Takeda et al. | 313/496 |
| 2005/0236952 | A1 | 10/2005 | Moriguchi et al. | 313/310 |
| 2005/0258734 | A1 | 11/2005 | Nukanobu et al. | 313/495 |
| 2006/0003660 | A1 | 1/2006 | Kobayashi et al. | 445/5 |

FOREIGN PATENT DOCUMENTS

| | | |
|---|---|---|
| EP | 1 347 487 A2 | 9/2003 |
| JP | 11/283493 | 10/1999 |
| JP | 2000-231872 | 8/2000 |

* cited by examiner

ELECTRON-EMITTING DEVICE, ELECTRON SOURCE, IMAGE DISPLAY APPARATUS, AND THEIR MANUFACTURING METHOD

BACKGROUND OF THE INVENTION

1. Field of the Invention

The invention relates to a surface conduction electron-emitting device, an electron source using such an electron-emitting device, an image display apparatus, and their manufacturing method.

2. Related Background Art

Hitherto, there has been known an electron-emitting device in which a pair of electroconductors is arranged on a substrate surface at an interval, the substrate surface between the pair of electroconductors has a groove portion, and by applying a predetermined voltage across the electroconductors, an electron is emitted from the electroconductor portion (refer to Japanese Patent Application Laid-Open No. 2000-231872).

FIGS. 9A and 9B show a construction of the electron-emitting device disclosed in Japanese Patent Application Laid-Open No. 2000-231872. In the diagrams, reference numeral 101 denotes a substrate; 102 and 103 device electrodes; 104 an electroconductive thin film; 105 a carbon film; 106 a groove portion; and 107 an electron-emitting region. FIG. 9A is a schematic plan view of such a device. FIG. 9B is a schematic cross sectional view taken along the line 9B-9B' in FIG. 9A.

As a manufacturing method of the electron-emitting device of FIGS. 9A and 9B, the device electrodes 102 and 103 are formed on the substrate 101, the continuous electroconductive thin film 104 is formed so as to connect the device electrodes 102 and 103, thereafter, a gap is formed by applying a forming voltage across the device electrodes 102 and 103 (forming step), and the carbon films 105 containing carbon and/or a carbon compound as a main component are further deposited on the electroconductive thin films 104 of the both electrode sides (activating step). At this time, in the substrate 101 under the gap formed in the electroconductive thin film 104, the groove portion 106 in which a material of the substrate is altered by the heat of the activation is formed.

SUMMARY OF THE INVENTION

It is an object of the invention to provide an electron-emitting device which is improved in stability and its manufacturing method.

Another object of the invention is to provide a manufacturing method of an electron-emitting device which is improved in stability, especially, in high efficiency and a long life, and its manufacturing method.

According to the invention, there is provided an electron-emitting device having a pair of electroconductors arranged on a substrate at an interval, wherein a top of one of the pair of electroconductors is higher than that of the other electroconductor and a groove extending from the interval region toward a position under a region where the one electroconductor is come into contact with the substrate is formed on the substrate along the interval.

According to the invention, there is also provided a manufacturing method of an electron-emitting device having a pair of electroconductive members arranged on a substrate at an interval and a film which contains carbon as a main component and covers each of the pair of electroconductive members, comprising the step of applying voltage pulses of both polarities across the pair of electroconductive members arranged on the substrate at the interval in an atmosphere containing carbon compound gases, wherein in the voltage pulses of the both polarities, an absolute value of the voltage pulse of the same polarity as that of the voltage pulse applied at the time of driving the electron-emitting device is larger than an absolute value of the voltage pulse of the opposite polarity.

According to the invention, there is also provided a manufacturing method of an electron-emitting device having a pair of electroconductive members arranged on a substrate at an interval and a film which contains carbon as a main component and covers each of the pair of electroconductive members, comprising the step of applying voltage pulses of both polarities across the pair of electroconductive members arranged on the substrate at the interval in an atmosphere containing carbon compound gases, wherein in the voltage pulses of the both polarities, a quiescent period until the voltage pulse of the same polarity side is applied after applying the voltage pulse of the polarity opposite to that of the voltage pulse applied at the time of driving the electron-emitting device is shorter than a quiescent period until the voltage pulse of the opposite polarity is applied after applying the voltage pulse of the same polarity.

DETAILED DESCRIPTION OF THE PREFERRED EMBODIMENTS

Figure 1A:
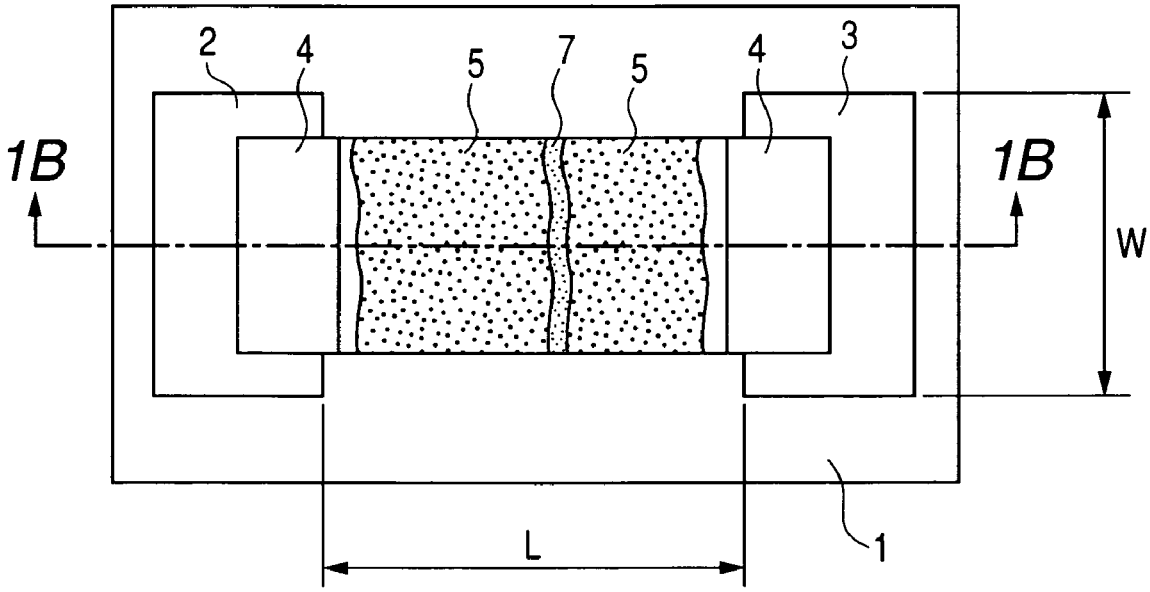
FIGS. 1A and 1B are schematic diagrams of an embodiment of an electron-emitting device of the invention.

The first aspect of the invention provides an electron-emitting device having a pair of electroconductors arranged on a substrate at an interval, wherein a top of one of the pair of electroconductors is higher than that of the other electroconductor and a groove extending from the interval region toward a position under a region where the one electroconductor is come into contact with the substrate is formed on the substrate along the interval.

The second aspect of the invention provides an electron source having a plurality of electron-emitting devices on a substrate, wherein the electron-emitting device is the electron-emitting device according to the first aspect of the invention.

The third aspect of the invention provides an image display apparatus comprising: an electron source having a plurality of electron-emitting devices on a substrate; and phosphor members which emit light by electrons emitted from the electron-emitting devices, wherein the electron source is the electron source according to the second aspect of the invention.

The fourth aspect of the invention provides a manufacturing method of an electron-emitting device having a pair of electroconductive members arranged on a substrate at an interval and a film which contains carbon as a main component and covers each of the pair of electroconductive members, comprising the step of applying voltage pulses of both polarities across the pair of electroconductive members arranged on the substrate at the interval in an atmosphere containing carbon compound gases, wherein in the voltage pulses of the both polarities, an absolute value of the voltage pulse of the same polarity as that of the voltage pulse applied at the time of driving the electron-emitting device is larger than an absolute value of the voltage pulse of the opposite polarity.

The fifth aspect of the invention provides a manufacturing method of an electron-emitting device having a pair of electroconductive members arranged on a substrate at an interval and a film which contains carbon as a main component and covers each of the pair of electroconductive members, comprising the step of applying voltage pulses of both polarities across the pair of electroconductive members arranged on the substrate at the interval in an atmosphere containing carbon compound gases, wherein in the voltage pulses of the both polarities, a quiescent period until the voltage pulse of the same polarity side is applied after applying the voltage pulse of the polarity opposite to that of the voltage pulse applied at the time of driving the electron-emitting device is shorter than a quiescent period until the voltage pulse of the opposite polarity is applied after applying the voltage pulse of the same polarity.

The sixth aspect of the invention provides a manufacturing method of an electron-emitting device having a pair of electroconductive members arranged on a substrate at an interval and a film which contains carbon as a main component and covers each of the pair of electroconductive members, comprising the step of applying voltage pulses of both polarities across the pair of electroconductive members arranged on the substrate at the interval in an atmosphere containing carbon compound gases, wherein in the voltage pulses of the both polarities, an absolute value of the voltage pulse of the same polarity as that of the voltage pulse applied at the time of driving the electron-emitting device is larger than an absolute value of the voltage pulse of the opposite polarity, and a quiescent period until the voltage pulse of the same polarity side is applied after applying the voltage pulse of the opposite polarity is shorter than a quiescent period until the voltage pulse of the opposite polarity is applied after applying the voltage pulse of the same polarity.

The seventh aspect of the invention provides a manufacturing method of an electron source having a plurality of electron-emitting devices each comprising a pair of electroconductive members arranged on a substrate at an interval and a film which contains carbon as a main component and covers each of the pair of electroconductive members, wherein the electron-emitting device is manufactured by the manufacturing method of the electron-emitting device according to any one of the fourth to sixth aspects of the invention.

The eighth aspect of the invention provides a manufacturing method of an image display apparatus comprising: an electron source having a plurality of electron-emitting devices each having a pair of electroconductive members arranged on a substrate at an interval and a film which contains carbon as a main component and covers each of the pair of electroconductive members; and phosphor members which emit light by electrons emitted from the electron-emitting devices, wherein the electron source is manufactured by the manufacturing method of the electron source according to the seventh aspect of the invention.

Since the electron-emitting device of the invention has the asymmetrical electron-emitting regions and has a structure in which the deterioration that is caused by the collision of charged particles is suppressed, the electron-emitting characteristics which are more stable than those in the conventional device are obtained. Therefore, the more stable image display apparatus of low electric power consumption and low costs can be obtained by using the electron-emitting device of the invention.

An embodiment of the invention will be described in detail hereinbelow with reference to the drawings. Dimensions, materials, shapes, relative layouts, and the like of component elements disclosed in the embodiment do not limit the scope of the invention only to them unless otherwise specified in particular.

Figure 1B:
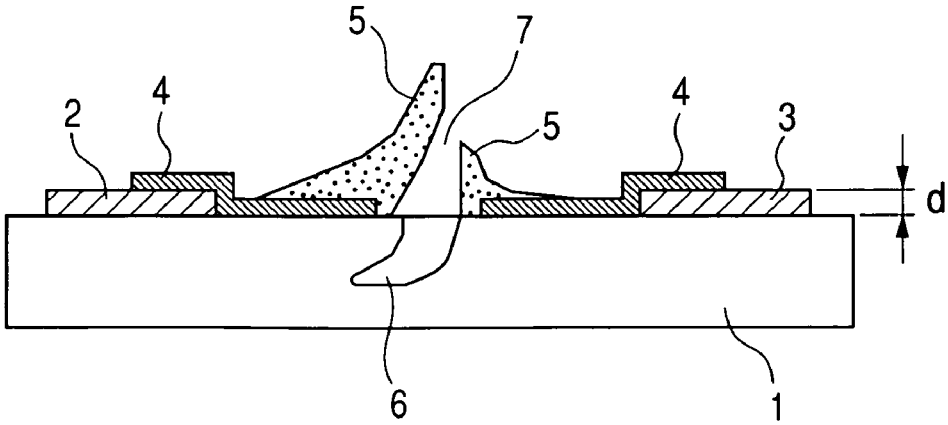

FIGS. 1A and 1B show a construction of an embodiment of the electron-emitting device of the invention. In the diagram, reference numeral 1 denotes a substrate; 2 and 3 device electrodes; 4 an electroconductive thin film; 5 a carbon film; 6 a groove portion; and 7 an electron-emitting region. FIG. 1A is a schematic plan view of the device. FIG. 1B is a schematic cross sectional view taken along the line 1B-1B in FIG. 1A.

A manufacturing method of the electron-emitting device of the invention will now be described with reference to a manufacturing step of the device shown in FIGS. 1A and 1B as an example.

(Step 1)

The device electrodes 2 and 3 are formed on the substrate 1. Quartz glass, glass in which a content of impurities such as Na or the like is reduced, soda lime glass, a substrate obtained by laminating an $SiO_2$ layer or an SiN layer onto the glass in which the content of impurities such as Na or the like is reduced, ceramics of alumina or the like, an Si substrate, or the like can be used as a substrate 1.

A metal such as Ni, Cr, Au, Mo, W, Pt, Ti, Al, Cu, Pd, Ru, or the like, an alloy of them, or the like is preferable as a material of the device electrodes 2 and 3, or a print conductor made of a metal oxide and glass or the like or a transparent conductor such as ITO or the like can be used.

An interval L between the device electrodes 2 and 3, a width W of device electrode, and the like are designed in consideration of a form or the like which is applied. The interval L between the device electrodes can be preferably set to a value within a range from hundreds of nm to hundreds of μm, more preferably, a range from a few μm to tens of μm. The device electrode width W can be set to a value within a range from a few μm to hundreds of μm in consideration of a resistance value of the electrode and the electron-emitting characteristics. A film thickness d of each of the device electrodes 2 and 3 can be set to a value within a range from tens of nm to a few μm.

(Step 2)

The continuous electroconductive thin film 4 connecting the device electrodes 2 and 3 is formed.

It is preferable to use a fine-grain film made of fine grain as an electroconductive thin film 4 in order to obtain the better electron-emitting characteristics. A film thickness of electroconductive thin film 4 is properly selected in consideration of step coverage, processing conditions of a forming step, which will be explained hereinafter, and the like. It is preferably set to a value within a range from 0.1 nm to 100 nm, more preferably, a range from 1 nm to 50 nm.

As a material constructing the electroconductive thin film 4, there can be mentioned: a metal such as Pd, Pt, Ru, Ag, Au, Ti, In, Cu, Cr, Fe, Zn, Sn, Ta, W, Pb, or the like; an oxide such as PdO, $SnO_2$, $In_2O_3$, PbO, $Sb_2O_3$, $RuO_2$, or the like; a boride such as $HfB_2$, $ZrB_2$, $LaB_6$, $CeB_6$, $YB_4$, $GdB_4$, or the like; a carbide such as TiC, ZrC, HfC, TaC, SiC, WC, or the like; a nitride such as TiN, ZrN, HfN, or the like; a semiconductor of Si, Ge, or the like; carbon; or the like.

It is preferable that the electroconductive thin film 4 shows a sheet resistance value of $1\times10^7$ Ω/□ or less. The sheet resistance value denotes Rs which satisfies R=Rs(l/W) when it is assumed that a resistance of the thin film having a width w and a length l is labeled to R.

The sheet resistance value of the electroconductive thin film 4 is limited as a resistance value in which a preferable gap can be formed in the forming step, which will be explained hereinafter. To form the preferable gap, it is desirable that the resistance value lies within a range from $1\times10^3$ to $1\times10^7$Ω/□.

After the electron-emitting region 7 is formed, it is preferable that a voltage which is applied through the device electrodes 2 and 3 is sufficiently applied to the electron-emitting region 7. It is more preferable that the resistance value of the electroconductive thin film 4 is smaller.

Therefore, it is desirable that the electroconductive thin film 4 is formed as a metal oxide semiconductor thin film having a resistance value in the range from $1\times10^3$ to $1\times10^7$Ω/□, reduced after the forming step, which will be explained hereinafter, and used as a metal thin film having a smaller resistance value.

Therefore, a lower limit of the resistance value of the electroconductive thin film 4 in the final state is not particularly limited. The resistance value of the electroconductive thin film 4 used here denotes a resistance value which is measured in a region including no gap.

(Step 3)

By applying a forming voltage across the device electrodes 2 and 3, a part of the electroconductive thin film 4 is deformed and altered, thereby forming a gap and forming the electron-emitting region 7. This step is called a forming step.

In the forming step, it is desirable to use a pulse voltage as a voltage which is applied across the device electrodes 2 and 3. At this time, there are a case where a pulse peak value is made constant and a case where the voltage is applied while increasing the pulse peak value. A method of applying the pulse voltage and a voltage value, a pulse width, and a pulse interval of the pulse voltage which is applied are properly selected in accordance with the material, film thickness, resistance value, and the like of the electroconductive thin film 4. It is also preferable to execute the forming step in the vacuum or in the atmosphere containing a reductive gas such as hydrogen or the like.

(Step 4)

After the forming step, the activating step is executed. Specifically speaking, voltage pulses of both polarities are applied across the device electrodes 2 and 3 in the atmosphere containing carbon compound gases, thereby depositing the carbon film 5 containing carbon as a main component into the gap of the electroconductive thin film 4 and on the electroconductive thin film 4. In this step, it can be also said that the device electrode 2 and the electroconductive thin film 4 form an electroconductive member, the device electrode 3 and the electroconductive thin film 4 form an electroconductive member, and the voltage pulses of both polarities are applied across the pair of electroconductive members.

In this example, carbon is, for example, graphite (containing what is called HOPG, PG, and GC: HOPG denotes a crystalline structure of almost perfect graphite; PG denotes a slightly disordered crystalline structure in which a crystal grain is equal to about 20 nm; GC denotes a further disordered crystalline structure in which a crystal grain is equal to about 2 nm) and amorphous carbon (which denotes amorphous carbon and a mixture of amorphous carbon and microcrystal of graphite).

The invention is characterized in that the pulses of both polarities which are used in the activating step have a predetermined relation with the polarity of the voltage pulse at driving of the electron-emitting device.

Figure 2:
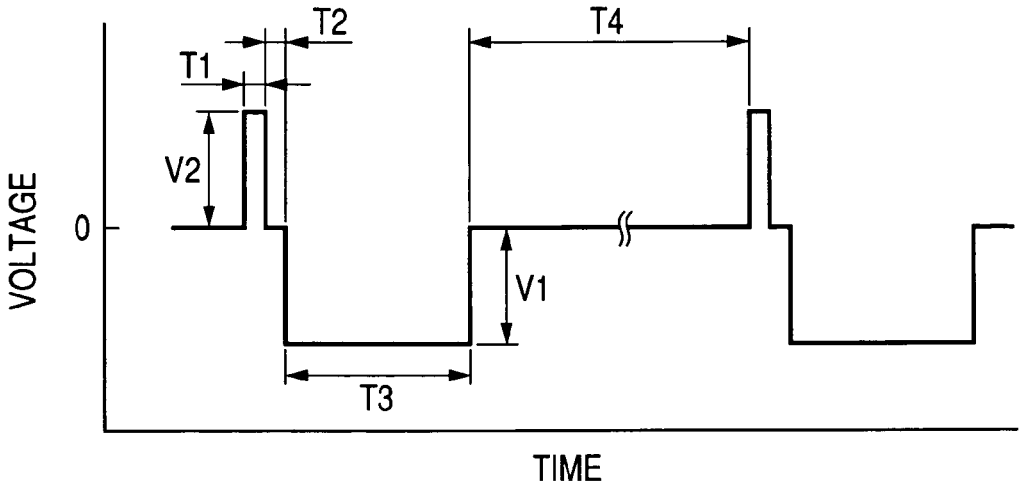
FIG. 2 is a waveform diagram of an example of a voltage pulse which is used in an activating step according to the invention.
Figure 3:
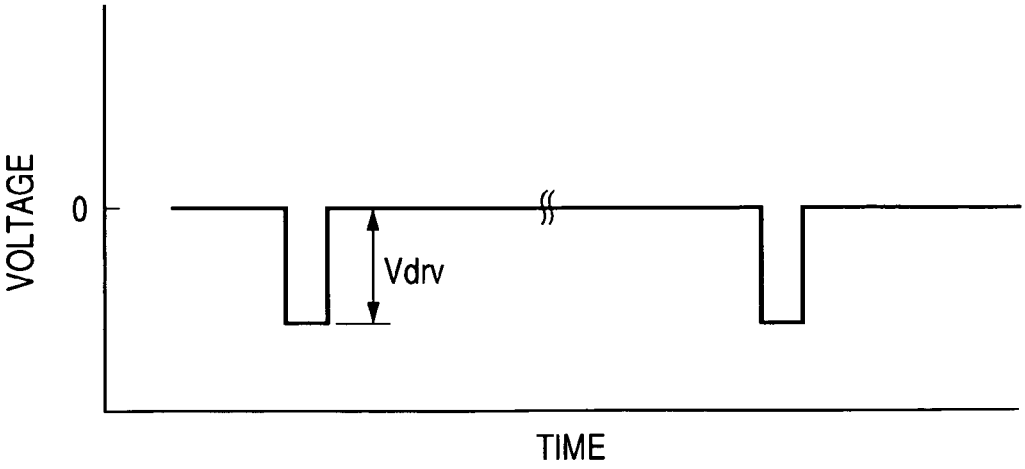
FIG. 3 is a driving waveform diagram of the electron-emitting device of the invention.

FIG. 2 shows an example of a waveform of the voltage pulse which is used in the activating step in the invention. FIG. 3 shows an example of a waveform of the voltage pulse at driving which is used in combination with FIG. 2.

The voltage pulses which are used in the activating step in the invention satisfies either the following condition (1) or (2).

(1) An absolute value of a voltage pulse V1 of the same polarity as that of a voltage pulse Vdrv upon driving is larger than an absolute value of a voltage pulse V2 of the opposite polarity.

(2) A quiescent period T2 until the voltage pulse V1 of the same polarity is applied after applying the voltage pulse V2 of the polarity opposite to that of the voltage pulse at driving is shorter than a quiescent period T4 until the voltage pulse V2 of the opposite polarity is applied after applying the voltage pulse V1 of the same polarity.

In the case of (1), the voltage pulses are set so as to satisfy the relation (|V1|≧|V2|). In the case of (2), the quiescent periods are set so as to satisfy the relation (T2≦T4). Preferably, the pulse waveform is set so as to satisfy both of (1) and (2).

In the voltage pulses which are used in the activating step, |V1| is set to a value within a range of 22 to 30V and |V2| is set to a value within a range of 20 to 24V. A pulse width T1 is set to a value within a range of 0.01 to 0.2 msec. A pulse width T3 is set to a value within a range of 0.1 to 2 msec. A pulse interval T2 is set to a value within a range of 0.01 to 0.2 msec. A pulse interval T4 is set to a value within a range of 0.01 to 120 msec. Preferably, one period (T1+T2+T3+T4) is set to a value within a range of 2 to 120 msec.

Although the pulse widths can be set to (T1=T3) in both of (1) and (2), preferably, they are set to (T1<T3).

By applying the asymmetrical voltage pulses as mentioned above, the carbon films 5 are asymmetrically formed on the electroconductive thin films 4, so that the electron-emitting region 7 is formed. There is formed a structure in which an electroconductor comprising the device electrode 2, electroconductive thin film 4, and carbon film 5 and an electroconductor comprising the device electrode 3, electroconductive thin film 4, and carbon film 5 are arranged at an interval and a top (portion which is farthest from the substrate 1) of one electroconductor (on the side of the device electrode 2 in FIGS. 1A and 1B) is higher than that of the other electroconductor (on the side of the device electrode 3 in FIGS. 1A and 1B). At the same time, since the heat upon activation occurs alternately and asymmetrically, alteration of the substrate 1 occurs in a lower portion of the electroconductor (the device electrode 2+the electroconductive thin film 4). It is, consequently, considered that the groove portion 6 extending from the interval region toward the downward of a region where one electroconductor is come into contact with the substrate is formed along the interval between the electroconductors. As shown in FIGS. 1A and 1B, it is desirable that the deepest portion of the groove portion 6 is located under the region where one electroconductor is come into contact with the substrate.

The electron-emitting device of FIGS. 1A and 1B applies the voltage pulse of the same polarity as that upon driving to the device electrode 2 side.

In the activating step according to the invention, while exhausting the inside of a vacuum container by an oil-free pump such as a turbo molecular pump or the like, carbon compound gases are introduced into the container so as to keep a predetermined pressure.

As a proper carbon compound which is used in the activating step, an aliphatic hydrocarbon class of alkane, alkene, or alkyne, an aromatic hydrocarbon class, an alcohol class, an aldehyde class, a ketone class, an amine class, an organic acid class such as phenol, carvone, or sulfonic acid, or the like can be mentioned. Specifically speaking, it is possible to use: saturated hydrocarbon expressed by $C_nH_{2n+2}$ such as methane, ethane, propane, or the like; unsaturated hydrocarbon expressed by a composition formula such as $C_nH_{2n}$ of ethylene, propylene, or the like; benzene; toluene; methanol; ethanol; formaldehyde; acetaldehyde; acetone; methylethyl ketone; methylamine; ethylamine; phenol; benzonitrile; trinitrile; formic acid; acetic acid; propionic acid; or the like; or their mixture.

Since a partial pressure of the preferable carbon compound gases at this time differs depending on a shape of the vacuum container, a kind of carbon compound, and the like, it is properly set according to circumstances.

Since the electron-emitting device formed as mentioned above has a simple construction and can be easily manufactured, a number of electron-emitting devices can be arranged and formed in a large area. Therefore, by forming a plurality of electron-emitting devices onto the substrate and electrically connecting those electron-emitting devices by wirings, the electron source of the large area can be easily formed.

Figure 7:
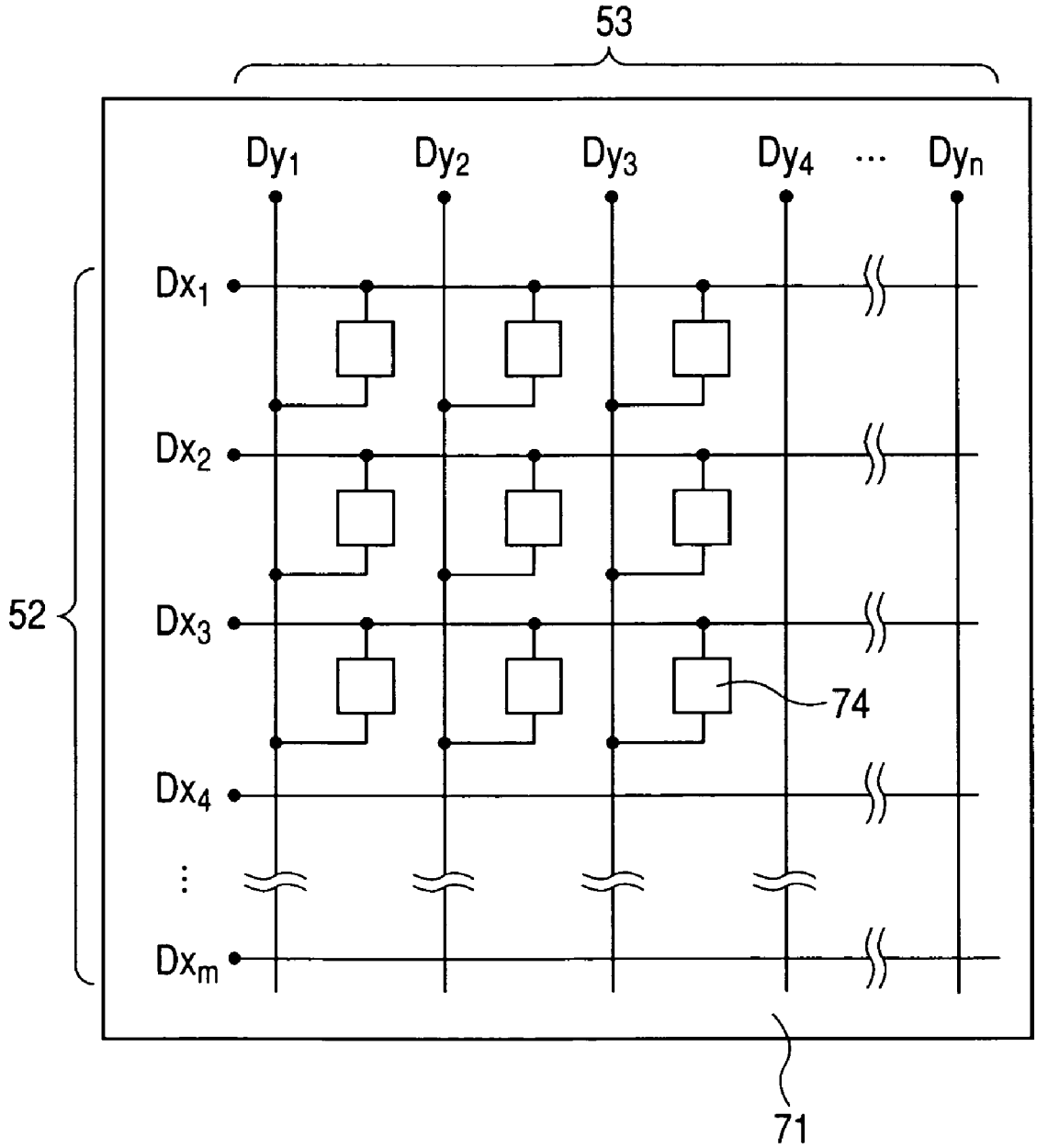
FIG. 7 is a schematic diagram showing a construction of the embodiment of the electron source of the invention.

In the electron source in which a plurality of electron-emitting devices are arranged on the substrate, various layouts of the electron-emitting devices can be used. As an example of such a layout, an electron source in which electron-emitting devices 74 are arranged in a matrix form as shown in FIG. 7 can be mentioned. In the diagram, reference numeral 71 denotes an electron source substrate; 52 row-directional (Y-direction) wirings; 53 column-directional (X-direction) wirings; and 74 the electron-emitting devices. One of the electrodes of each of the plurality of electron-emitting devices arranged on the same row is connected to the common row-directional wiring 52. The other electrode of each of the plurality of electron-emitting devices arranged on the same column is connected to the common column-directional wiring 53. Such a wiring method is called a simple matrix wiring.

In the electron source in which the plurality of electron-emitting devices are wired in a simple matrix form, when the operator wants to drive arbitrary electron-emitting devices in the matrix, a voltage Vx is applied to the column-directional wiring 53 to which the electron-emitting devices to be driven are connected. Synchronously with the supply of the voltage Vx, a voltage −Vy having the polarity opposite to that of the voltage Vx is applied to the row-directional wiring 52 to which the electron-emitting devices to be driven are connected. At this time, a differential voltage (Vx+Vy) is applied to the electron-emitting devices to be driven. The voltage Vx is applied to the electron-emitting devices arranged on the same column as that of the electron-emitting devices to be driven. The voltage Vy is applied to the electron-emitting devices arranged on the same row as that of the electron-emitting devices to be driven. By setting the voltages Vx and Vy to voltage values in which a desired electron-emission amount is obtained at the voltage (Vx+Vy) and the electrons are hardly emitted at the voltages Vx and Vy, the electrons can be selectively emitted from the desired electron-emitting devices.

According to the electron source in which the electron-emitting devices are arranged in the simple matrix form as mentioned above, since its construction and its driving method are simple, the image display apparatus can be constructed by combining it with the phosphor members which emit the light by the electrons emitted from the electron-emitting devices.

Figure 5:
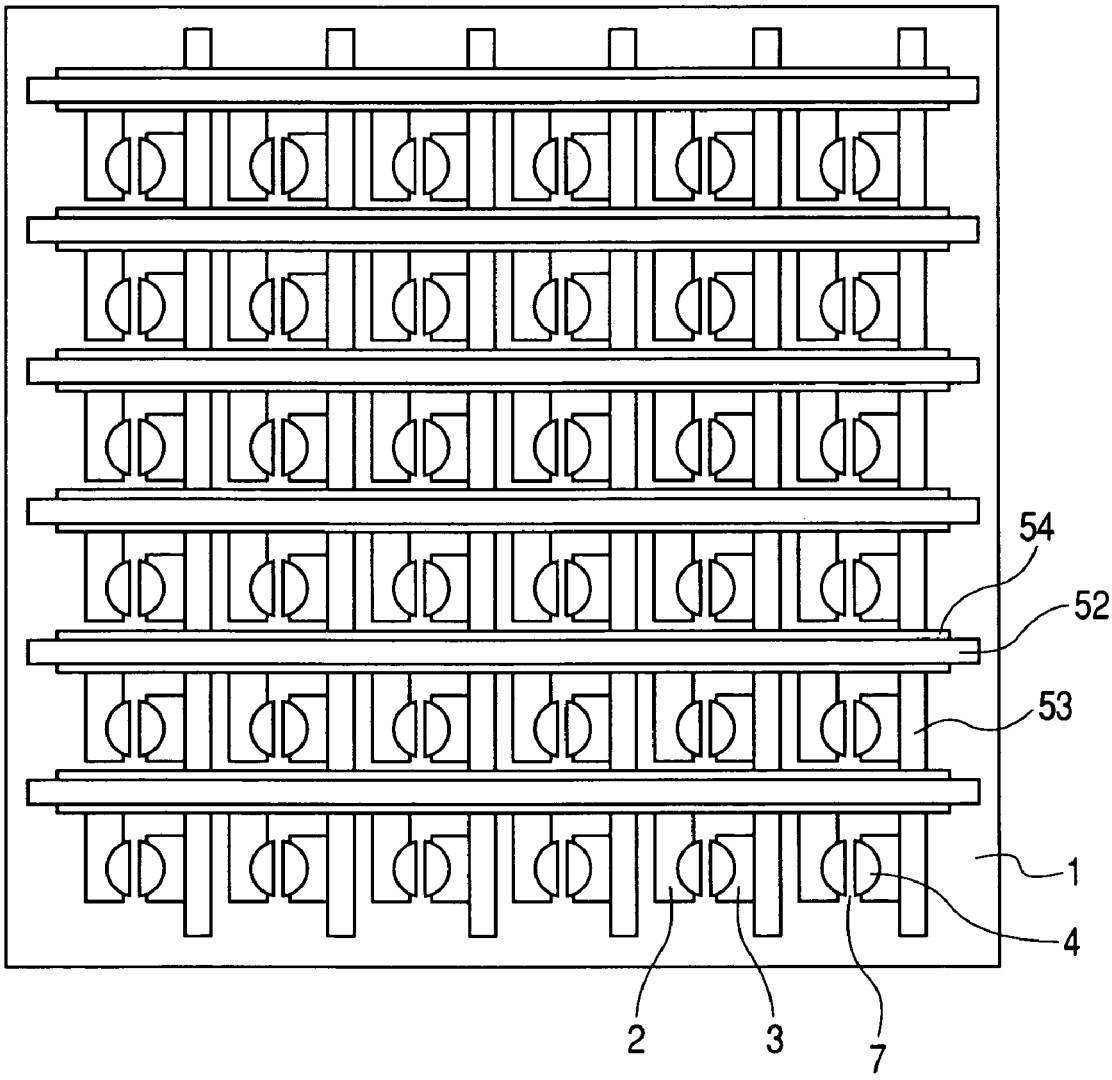
FIG. 5 is a schematic diagram showing a construction of an embodiment of the electron source of the invention.

First, the construction of the electron source of the invention will be described with reference to FIG. 5. FIG. 5 is a schematic plan view of an embodiment of the electron source with the simple matrix construction shown in FIG. 7. In the diagram, reference numeral 54 denotes an interlayer insulative layer and the same component elements as those in FIGS. 1A, 1B, and 7 are designated by the same reference numerals. For convenience of explanation, the carbon film 5 and the groove portion 6 in FIGS. 1A and 1B are omitted.

The manufacturing step of the electron source of FIG. 5 will now be described with reference to FIGS. 6A to 6E. Since materials of the component elements shown by the same reference numerals in FIGS. 1A and 1B are similar to those in the manufacturing step of the electron-emitting devices mentioned above, their description is omitted.

(Step 1)

Figure 6A:
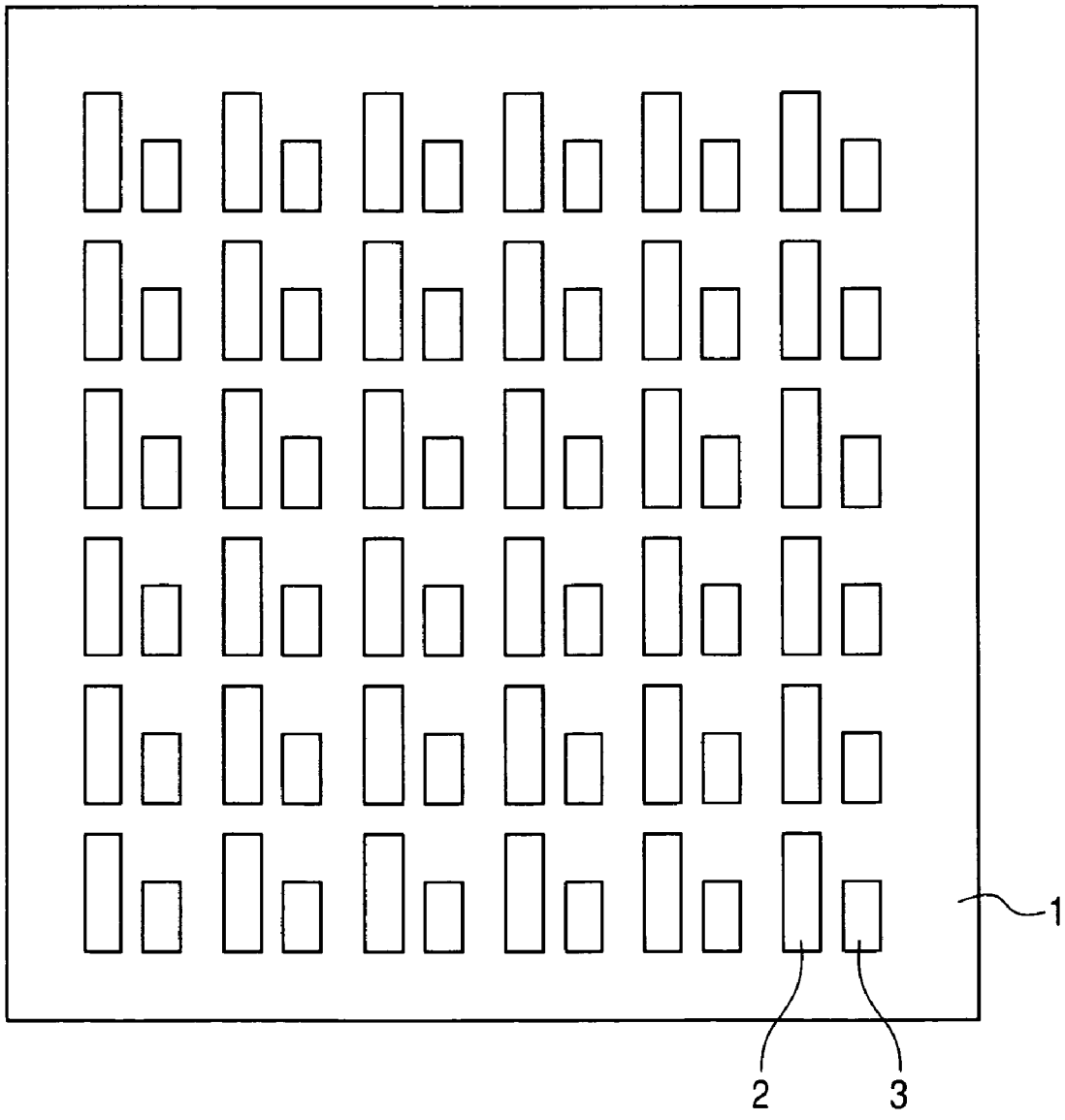
FIG. 6A is a diagram showing a manufacturing step of the electron source in FIG. 5.

The substrate 1 is sufficiently cleaned by using a detergent, pure water, organic solvent, and the like and the device electrodes 2 and 3 are formed by using a combination of a vacuum evaporation depositing method, a sputtering method, and a photolithography technique, or a printing method, or the like (FIG. 6A).

(Step 2)

Figure 6B:
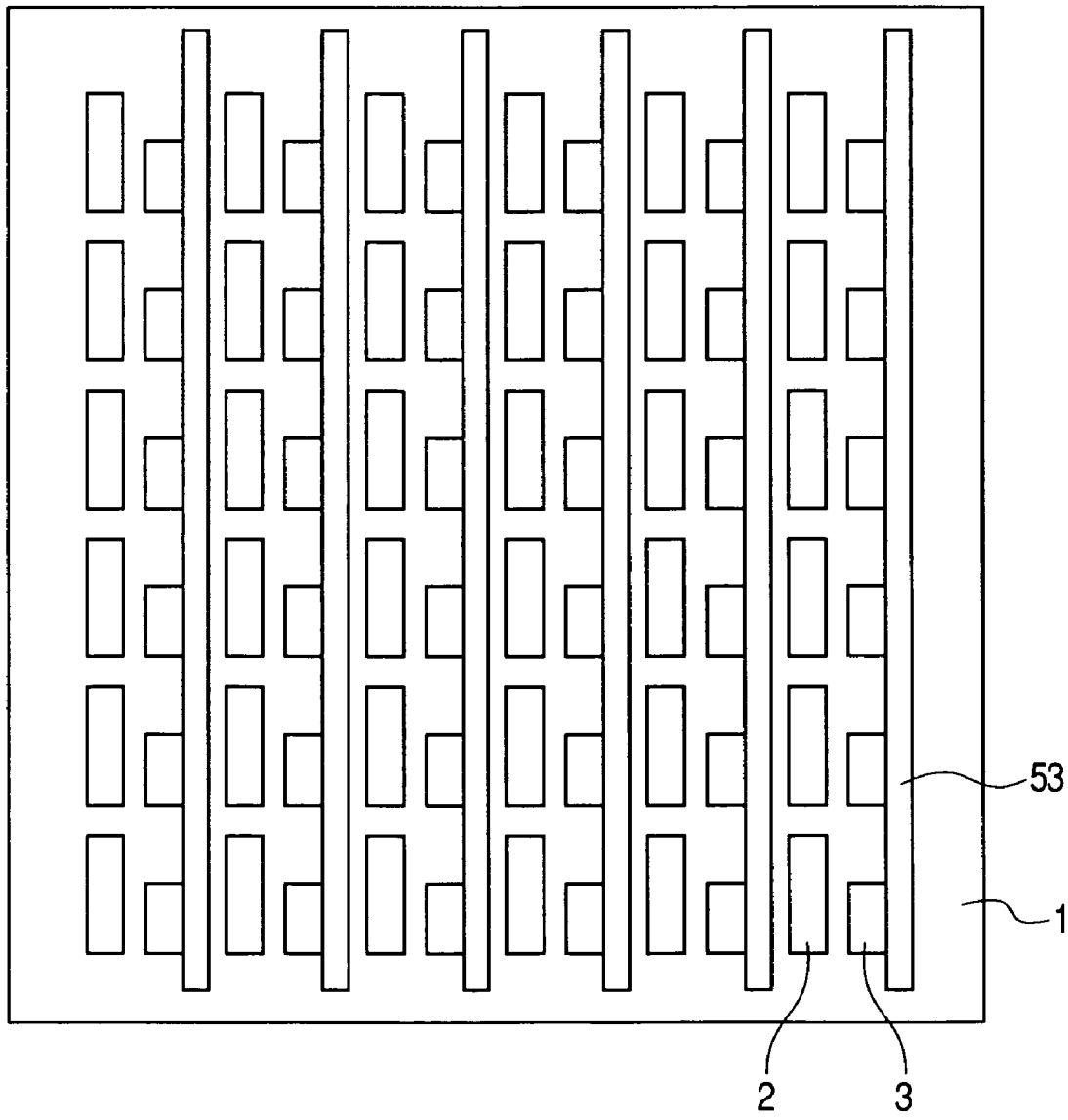
FIG. 6B is a diagram showing the manufacturing step of the electron source in FIG. 5.

The column-directional wirings 53 made of an electroconductive material such as a metal or the like are formed on the substrate 1 on which the device electrodes 2 and 3 have been formed by using the combination of the vacuum evaporation depositing method, the sputtering method, and the photolithography technique, or the printing method, or the like (FIG. 6B).

(Step 3)

Figure 6C:
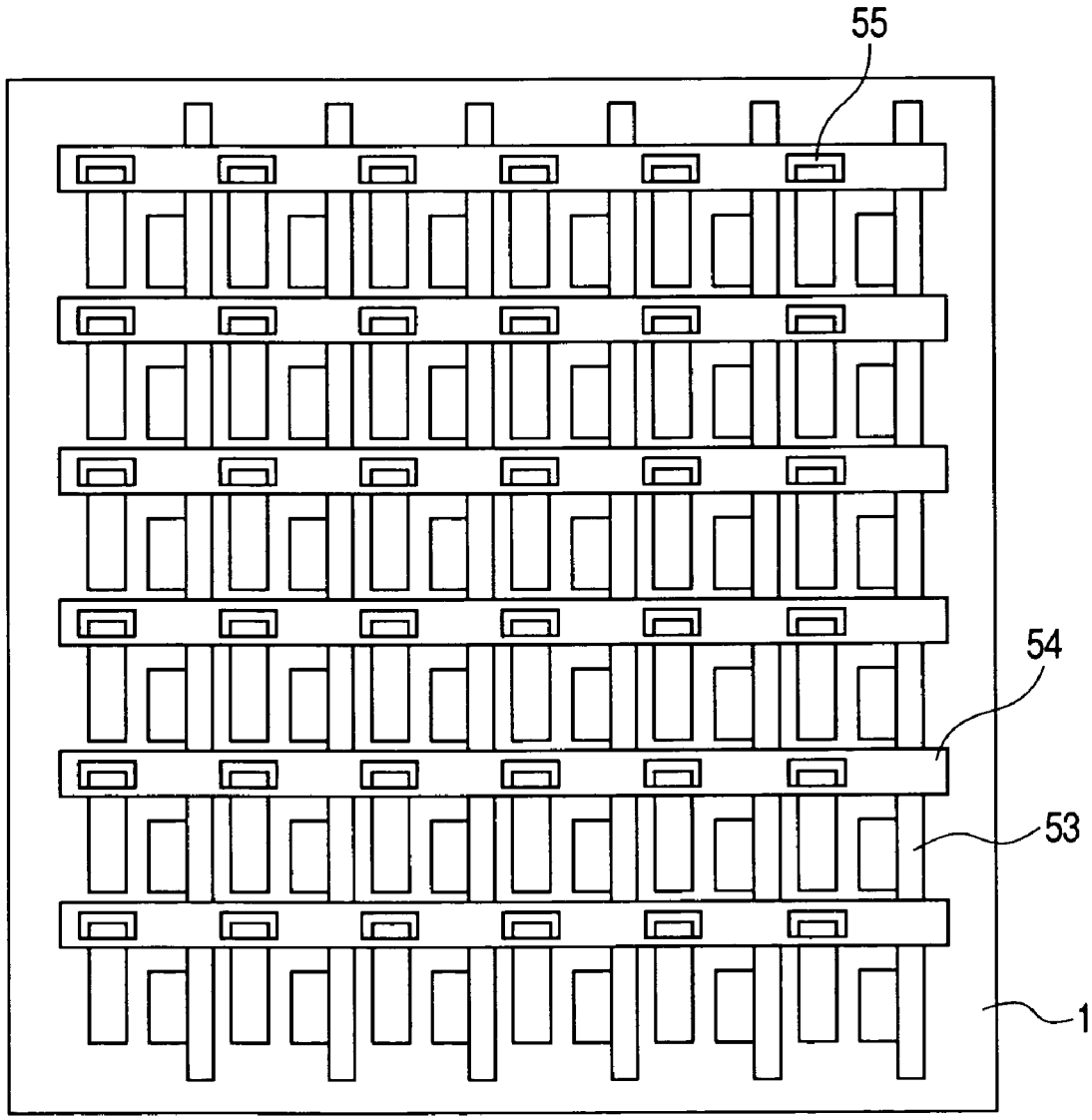
FIG. 6C is a diagram showing the manufacturing step of the electron source in FIG. 5.

The interlayer insulative layer 54 made of an insulative material containing silicon oxide, lead oxide, or the like as a main component is formed by using the combination of the vacuum evaporation depositing method, the sputtering method, and the photolithography technique, or the printing method, or the like (FIG. 6C). The interlayer insulative layer 54 is formed so as to cover crossing portions of the row-directional wirings 52 and the column-directional wirings 53. A material, a film thickness, and a manufacturing method of the interlayer insulative layer 54 are properly set so as to withstand the potential difference between both of those wirings. Contact holes 55 to electrically connect the device electrode 2 and the row-directional wirings 52 are formed.

(Step 4)

Figure 6D:
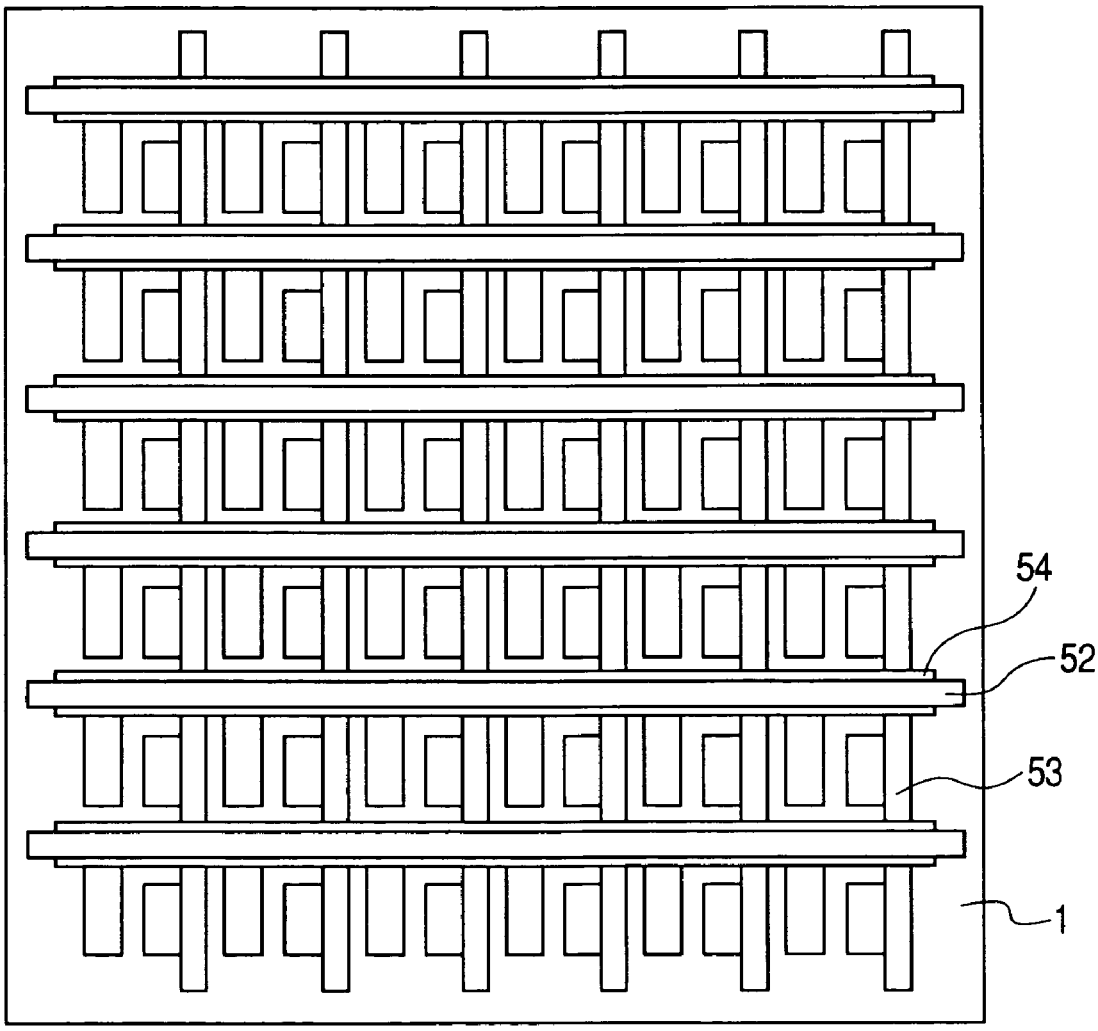
FIG. 6D is a diagram showing the manufacturing step of the electron source in FIG. 5.

The row-directional wirings 52 are formed on the interlayer insulative layer 54 in a manner similar to the column-directional wirings 53 (FIG. 6D). The row-directional wirings 52 and the column-directional wirings 53 are electrically connected to the pair of device electrodes 2 and 3 of each electron-emitting device.

(Step 5)

Figure 6E:
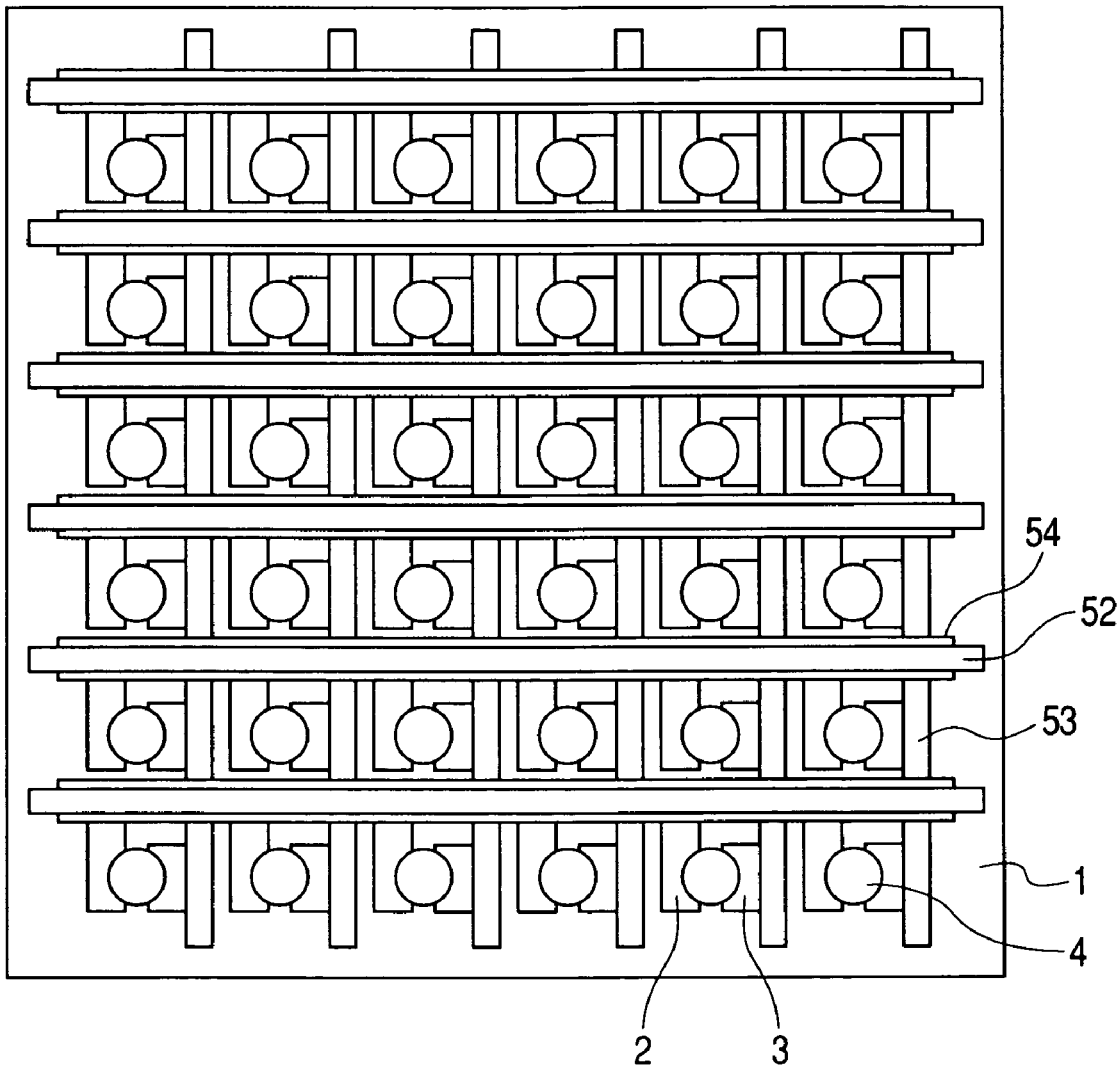
FIG. 6E is a diagram showing the manufacturing step of the electron source in FIG. 5.

The electroconductive thin film 4 is formed between the device electrodes 2 and 3 (FIG. 6E). The electroconductive thin film 4 can be formed by: a method whereby the material constructing the electroconductive thin film 4 is formed as a film by the sputtering method, vacuum evaporation depositing method, chemical vapor phase depositing method, or the like; a method whereby the gap between the device electrodes 2 and 3 is coated with a compound solution containing the material constructing the electroconductive thin film 4 by using a dipping method, a spin coating method, an ink-jet coating method, or the like; etc.

(Step 6)

The forming step is executed. The forming step can be executed by applying the voltage across the device electrodes 2 and 3 of each electron-emitting device through the row-directional wirings 52 and the column-directional wirings 53. Thus, the electroconductive thin film 4 of each electron-emitting device is locally destroyed, a gap is caused, and the electron-emitting region 7 is formed (FIG. 5).

(Step 7)

Subsequently, the activating step is executed. The activating step is executed by applying the voltage across the device electrodes 2 and 3 of each electron-emitting device through the row-directional wirings 52 and the column-directional wirings 53 in the atmosphere containing the carbon compound. By this step, carbon and/or carbon compound are/is deposited in the gap formed in the forming step and in the portion around the gap and the carbon film 5 is formed.

Figure 4:
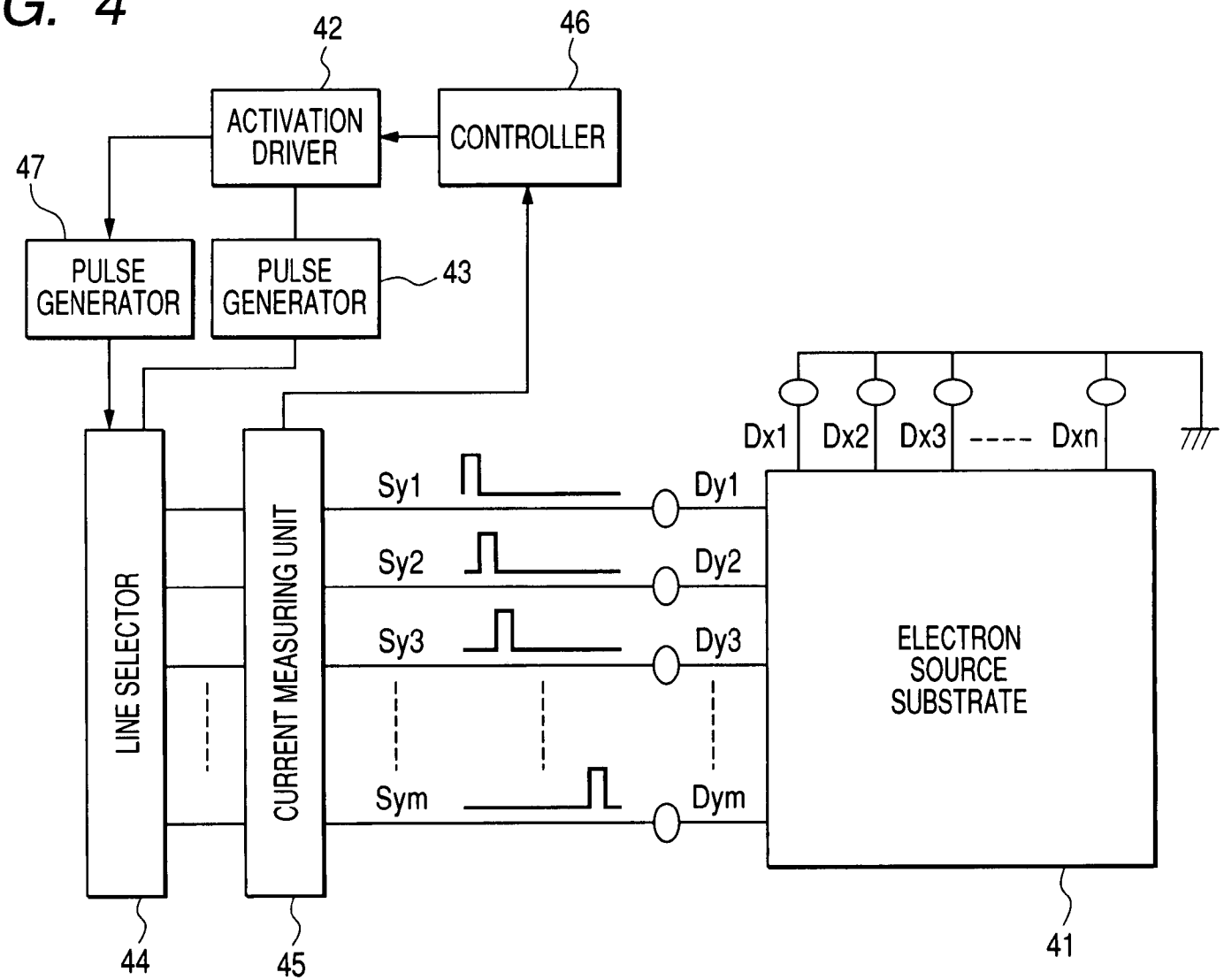
FIG. 4 is a connection diagram of voltage applying means and an electron source in the activating step of an electron source substrate according to the invention.

FIG. 4 is a connection diagram of the voltage applying means and the electron source in the activating step. In FIG. 4, reference numeral 41 denotes an electron source substrate; 42 an activation driver; 43 and 47 pulse generators; 44 a line selector; 45 a current measuring unit; and 46 a controller.

The pulse generator 43 and the line selector 44 are constructed in such a manner that a pulse oscillating period and a line selection switching period are synchronized by the activation driver 42.

The pulse voltage generated by the pulse generator 43 is inputted to the line selector 44 and outputted to one of output terminals Sy1 to Sym. The output terminals Sy1 to Sym are connected to row-directional wirings Dy1 to Dym of the electron source substrate 41, respectively. Column-directional wiring Dx1 to Dxn are coupled in common and connected to the ground level.

In the line selector 44, the output terminals Sy1 to Sym are connected to switches sw1 to swm (not shown), respectively. Each switch is connected to either an output portion of the pulse generator 43 or the ground level. The switching operation of each switch is independently controlled by the activation driver 42. Thus, the pulse voltages are sequentially applied to the row-directional wirings of the electron source substrate 41.

The current measuring unit 45 is a measuring unit of the device current flowing in each of the row-directional wirings Dy1 to Dym. Measurement values of the device currents are read out and inputted to the controller 46. The controller 46 controls the operation of the activation driver 42 on the basis of the measurement values. For example, the selection of the row-directional wirings to which the pulse voltages are applied, the waveform of the pulse voltage which is generated from the pulse generator 43, and the like are controlled. For example, the controller 46 controls so that another pulse voltage which is generated from the other pulse generator 47 is applied.

The activation is performed while sequentially applying the pulse voltages to the row-directional wirings of the electron source substrate 41 as mentioned above.

(Step 8)

Preferably, the stabilizing step is executed after the activating step. This step is a step of exhausting the carbon compound in the vacuum container. As a vacuum exhauster for exhausting the inside of the vacuum container, it is preferable to use an oil-free vacuum exhauster so that an oil which is generated from the exhauster does not exert an influence on characteristics of the device. Specifically speaking, a vacuum exhauster such as absorption pump, ion pump, or the like can be mentioned.

A partial pressure of the organic component in the vacuum container is a partial pressure at which carbon and carbon compound mentioned above are hardly newly deposited and is preferably set to $1\times10^{-6}$ Pa or less, more preferably, $1\times10^{-8}$ Pa or less.

Further, when the inside of the vacuum container is exhausted, it is desirable to heat the whole vacuum container so that the carbon compound molecules adsorbed on the inner wall of the vacuum container or on the electron-emitting device are easily exhausted.

It is desirable that a heating condition at this time is set so that the vacuum container is heated at temperatures of 150 to 350° C. for a processing time as long as possible. It is not, particularly, limited to such a heating condition but a proper heating condition is selected in accordance with various conditions such as size and shape of the vacuum container, construction of the electron-emitting device, and the like.

By using such a vacuum atmosphere, the deposition of new carbon or carbon compound can be suppressed and $H_2O$, $O_2$, and the like adsorbed onto the vacuum container, the substrate, and the like can be also removed, so that a device current If and an emission current Ie become stable.

Figure 8:
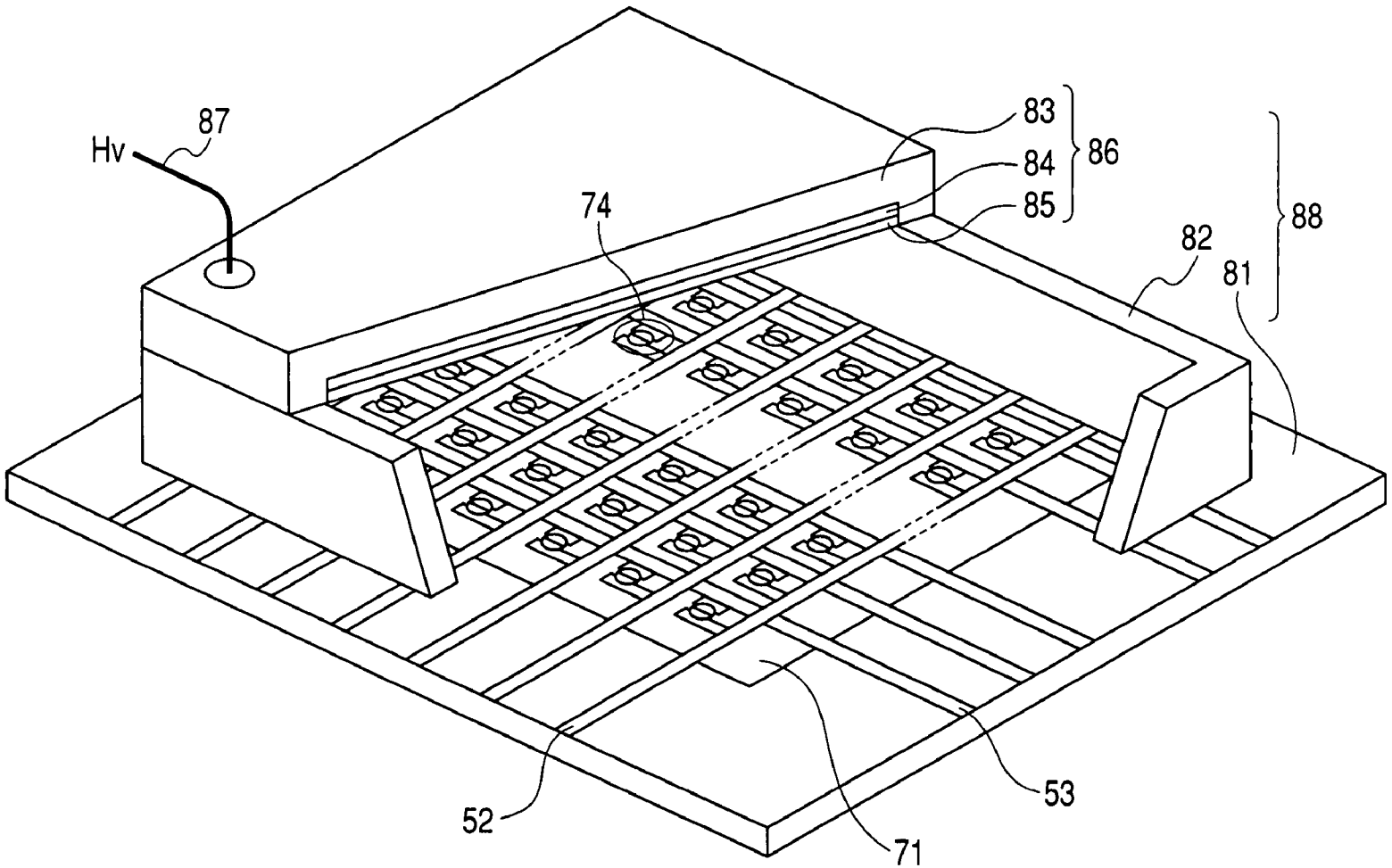
FIG. 8 is a schematic diagram showing a construction of a display panel of an image display apparatus of the invention.
Figure 9A:
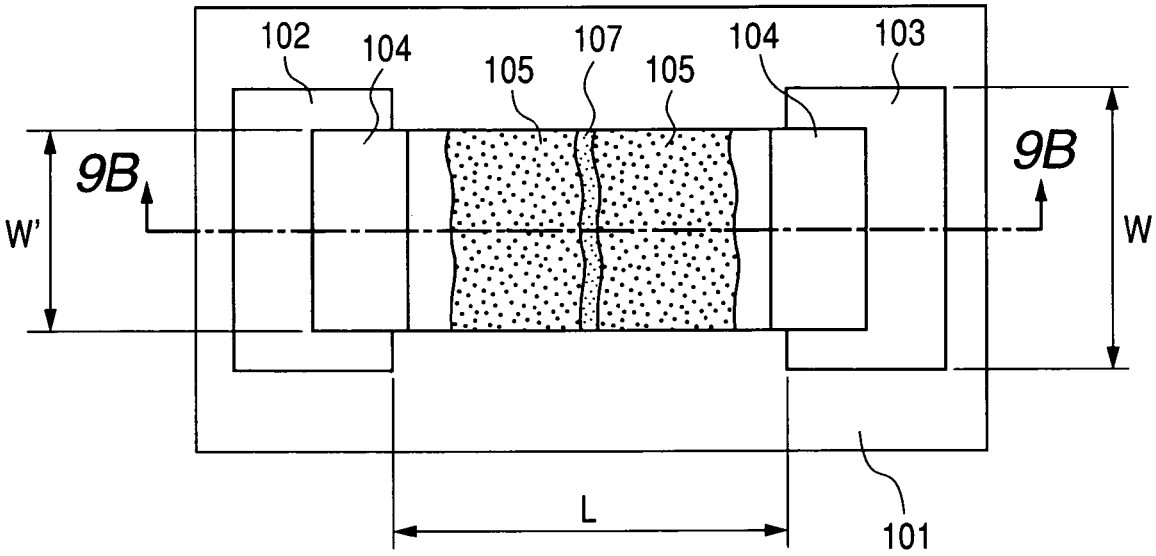
FIGS. 9A and 9B are schematic diagrams of an example of a conventional electron-emitting device.
Figure 9B:
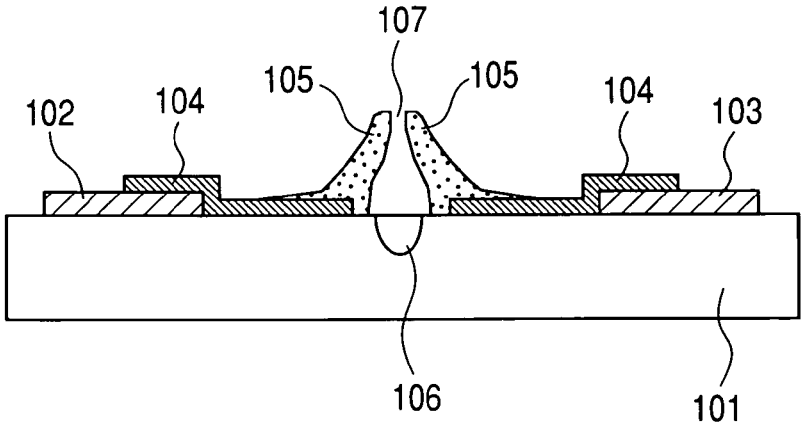

The image display apparatus constructed by the electron source manufactured as mentioned above will now be described with reference to FIG. 8. In FIG. 8, reference numeral 81 denotes a rear plate on which the electron source substrate 71 has been fixed; 86 a face plate (phosphor member) on which a phosphor film 84, a metal back 85, and the like have been formed on the inner surface of a glass substrate 83; and 82 a supporting frame. The rear plate 81 and the face plate 86 are coupled with the supporting frame 82 by using frit glass or the like of a low melting point. Reference numeral 87 denotes a high-voltage terminal and 88 indicates an envelope.

The envelope 88 is constructed by the face plate 86, supporting frame 82, and rear plate 81 as mentioned above.

Since the rear plate 81 is provided mainly to reinforce strength of the electron source substrate 71, if the electron source substrate 71 itself has the sufficient strength, the rear plate 81 which is provided as a separate member can be made unnecessary.

That is, it is also possible to directly seal-bond the supporting frame 82 to the electron source substrate 71 and construct the envelope 88 by the face plate 86, supporting frame 82, and electron source substrate 71.

By providing a supporting member (not shown) called a spacer between the face plate 86 and the rear plate 81, the envelope 88 having the sufficient strength against the atmospheric pressure can be also constructed.

EMBODIMENTS

Embodiments of the invention will be described hereinbelow.

Embodiment 1

Step (a)

The substrate 1 on which a silicon oxide film having a thickness of 500 nm has been formed on soda lime glass by a CVD method is cleaned with a detergent and pure water. After that, a lift-off pattern of the device electrodes 2 and 3 is formed by a photoresist (RD-2000N-41 made by Hitachi Chemical Co., Ltd.) and a Ti film having a thickness of 5 nm and a Pt film having a thickness of 100 nm are sequentially deposited by a vacuum evaporation depositing method.

Subsequently, the photoresist pattern is dissolved with an organic solvent, the Pt/Ti deposited film is lifted off, and the device electrodes 2 and 3 in which the device electrode interval L is equal to (L=20 μm) and the device electrode width W is equal to (W=200 μm) are formed.

Step (b)

Subsequently, a pattern of the column-directional wirings 53 is formed and printed by a screen printing method by using a paste material (NP-4028A made by Noritake Co., Ltd.) containing Ag as a metal component. After the printing, the pattern is dried at 110° C. for 20 minutes. Subsequently, the paste is baked by a heat treatment apparatus under the conditions of a peak temperature 480° C. and a peak holding time of 8 minutes and the column-directional wirings 53 are formed.

Step (c)

Subsequently, a pattern of the interlayer insulative layer 54 is printed by using a paste containing PbO as a main component and the paste is baked under conditions similar to those in step (b), and the interlayer insulative layer 54 is formed.

The interlayer insulative layer 54 is formed by opening the contact holes 55 to electrically connect the device electrode 2 and the row-directional wirings 52 so as to cover the regions including at least the crossing portions of the row-directional wirings 52 and the column-directional wirings 53.

Step (d)

A pattern of the row-directional wirings 52 is printed onto the insulative layer 54 by the screen printing method by using a material similar to that of the column-directional wirings 53. After the printing, the pattern is dried at 110° C. for 20 minutes. Subsequently, the paste is baked by the heat treatment apparatus under the conditions of the peak temperature 480° C. and the peak holding time of 8 minutes and the row-directional wirings 52 are formed.

Step (e)

Subsequently, a palladium complex solution (obtained by dissolving a palladium acetate monoethanol amine complex into a mixture solution of IPA and water) is dropped between the device electrodes 2 and 3 of each electron-emitting device by using an injecting apparatus of a bubble-jet (registered trademark) type. After that, a heat baking process is executed at 300° C. for 15 minutes and the electroconductive thin film 4 made of palladium oxide is formed. An average thickness of electroconductive thin film 4 formed in this manner is equal to 8 nm.

Step (f)

The substrate on which the electron-emitting devices, wirings, and interlayer insulative layers have been formed as mentioned above is put in the vacuum container and the inside of the container is exhausted by a vacuum pump. When a pressure in the container reaches $2\times10^{-3}$ Pa, an exhaust valve is closed. While 2% $H_2$ mixture $N_2$ gases are introduced into the container, a voltage is applied across the row-directional wirings 52 and the column-directional wirings 53 through terminals out of the container and the forming of the electron-emitting devices is executed.

The forming voltage is set to −14V and has a square wave of a pulse width of 1 msec and a pulse interval of 50 msec. In this instance, the column-directional wirings 53 are connected to the ground level in common and the voltages are applied while the row-directional wirings 52 are sequentially selected.

During the forming operation, a resistance measuring pulse of 1V is inserted between the pulses and a resistance is measured. When a measured value per device reaches about 1 M Ω or more, the supply of the voltage is finished. In this manner, the gap is formed in the electroconductive thin film 4 of each electron-emitting device.

Subsequently, the 2% $H_2$ mixture $N_2$ gases are introduced into the container until the pressure reaches $2\times10^{-4}$ Pa. After that, the device is held for 30 minutes and the electroconductive thin film 4 is reduced.

Step (g)

Subsequently, the inside of the vacuum container is exhausted by the vacuum pump. When the pressure in the container reaches $2\times10^{-5}$ Pa, trinitrile is introduced into the vacuum container through a slow leakage valve and the pressure of $1.3\times10^{-4}$ Pa is maintained.

After that, as shown in FIG. 4, the column-directional wirings 53 (Dx1 to Dxn) are connected to the ground level in common through the terminals out of the container, the pulse voltages are sequentially applied to the row-directional wirings 52 (Dy1 to Dym), and the activation operation is executed.

As for the pulse voltages in this instance, the pulse voltages of the both polarities shown in FIG. 2 are used. The pulse voltages are applied under the following conditions: V1=−22V, V2=+22V, T1=0.1 msec, T2=0.1 msec, T3=1 msec, T4=18.8 msec, and 1 period=20 msec. Upon activation, the foregoing pulses are continuously supplied for 30 minutes. After that, the electron source substrate after the activating step is extracted from the vacuum container and five arbitrary devices are observed with the SEM.

The structure of an arbitrary electron-emitting region is sliced by using an FIB working technique in order to observe a cross section. Thus, it has been found that most of the sliced cross sections have the structure shown in the schematic diagrams of FIGS. 1A and 1B, the groove portion 6 exists obliquely, and the deepest portion of the groove portion is located under the Pd thin film.

Step (h)

The electron source substrate after the activating step is put into the vacuum container again. While exhausting the inside of the vacuum container, the electron source substrate is heated at 300° C. and the vacuum container is heated at 200° C. for 10 hours, and the stabilization operation is executed.

With respect to the electron source formed as mentioned above, electron-emitting characteristics are evaluated in this vacuum container. The voltage is applied to the electron-emitting device through the terminals out of the container and the device current (If) flowing in the electron-emitting device at this time is measured. An anode electrode is attached 2 mm above the electron source substrate and the voltage is applied to the anode electrode. The emission current (Ie) emitted from the electron-emitting device is measured. The pressure in the vacuum exhauster at the time of measuring the electron-emitting characteristics is equal to $2\times10^{-8}$ Pa or less.

First, as preliminary driving, one (Dx1) of the column-directional wirings 53 is selected and the pulse voltage of +7.5V having a pulse width of 1 msec and a pulse interval of 16.6 msec is applied. Synchronously with it, the pulse voltage of −14V having a pulse width of 1 msec and a pulse interval of 16.6 msec is sequentially applied to the row-directional wirings 52 (Dy1 to Dym) by 10 pulses at a time. Subsequently, by repeatedly executing the similar operation with respect to other column-directional wirings 53 (Dx2 to Dxn), the pulse voltage of 21.5V is applied to all of the electron-emitting devices by 10 pulses at a time. At this time, unselected wirings are connected to the ground level.

Subsequently, one (Dx1) of the column-directional wirings 53 is similarly selected and the pulse voltage of +7.5V having a pulse width of 1 msec and a pulse interval of 16.6 msec is applied. Synchronously with it, the pulse voltage of −10.5V having a pulse width of 1 msec and a pulse interval of 16.6 msec is sequentially applied to the row-directional wirings 52 (Dy1 to Dym) each time for 300 seconds. Subsequently, by repeatedly executing the similar operation with respect to other column-directional wirings (Dx2 to Dxn), the pulse voltage of 18V is applied to all of the electron-emitting devices, thereby driving the devices. The device current (If) flowing in each electron-emitting device at this time is measured, the voltage of 1 kV is applied to the anode electrode, and the emission current (Ie) is measured. An average value of electron-emitting efficiency (=Ie/If) obtained from the measured device currents (If) and emission currents (Ie) is equal to 0.4% and it shows that excellent electron-emitting characteristics are obtained.

Embodiment 2

In a manner similar to steps (a) to (f) in the embodiment 1, electron-emitting devices are formed on the substrate and the processes up to the forming step are executed. Subsequently, the following steps are executed.

Step (g)

Subsequently, the inside of the vacuum container is exhausted by the vacuum pump. When the pressure in the container reaches $2\times10^{-5}$ Pa, trinitrile is introduced into the vacuum container through the slow leakage valve and the pressure of $1\times10^{-4}$ Pa is maintained.

After that, as shown in FIG. 4, the column-directional wirings 53 (Dx1 to Dxn) are connected to the ground level in common through the terminals out of the container, the pulse voltages are sequentially applied to the row-directional wirings 52 (Dy1 to Dym), and the activation operation is executed.

As for the pulse voltages in this instance, the pulse voltages of the both polarities shown in FIG. 2 are used. The pulse voltages are applied under the following conditions: V1=−23V, V2=+21V, T1=0.1 msec, T2=0.1 msec, T3=1 msec, and T4=18.8 msec.

In this manner, the pulse voltages are applied for 40 minutes and the activation is finished.

The electron source substrate after the activating step is extracted from the vacuum container and five arbitrary devices are observed with the SEM. The structure of an arbitrary electron-emitting region is sliced by using the FIB working technique in order to observe a cross section. Thus, it has been found that most of the sliced cross sections have the structure shown in the schematic diagrams of FIGS. 1A and 1B, the groove portion 6 exists obliquely, and the deepest portion of the groove portion 6 is located under the Pd thin film.

Step (h)

The electron source substrate is put into the vacuum container again. While exhausting the inside of the vacuum container, the electron source substrate is heated at 300° C. and the vacuum container is heated at 200° C. for 10 hours, and the stabilization operation is executed.

With respect to the electron source formed as mentioned above, electron-emitting characteristics are evaluated in this vacuum container. The voltage is applied to the electron-emitting device through the terminals out of the container and the device current (If) flowing in the electron-emitting device at this time is measured. The anode electrode is attached 2 mm above the electron source substrate and the voltage is applied to the anode electrode. The emission current (Ie) emitted from the electron-emitting device is measured. The pressure in the vacuum exhauster at the time of measuring the electron-emitting characteristics is equal to $2\times10^{-8}$ Pa or less.

First, as preliminary driving, one (Dx1) of the column-directional wirings 53 is selected and the pulse voltage of +7.5V having a pulse width of 1 msec and a pulse interval of 16.6 msec is applied. Synchronously with it, the pulse voltage of −15V having a pulse width of 1 msec and a pulse interval of 16.6 msec is sequentially applied to the row-directional wirings 52 (Dy1 to Dym) by 10 pulses at a time. Subsequently, by repeatedly executing the similar operation with respect to other column-directional wirings 53 (Dx2 to Dxn), the pulse voltage of 22.5V is applied to all of the electron-emitting devices by 10 pulses at a time. At this time, unselected wirings are connected to the ground level.

Subsequently, one (Dx1) of the column-directional wirings 53 is similarly selected and the pulse voltage of +7.5V having a pulse width of 1 msec and a pulse interval of 16.6 msec is applied. Synchronously with it, the pulse voltage of −11.5V having a pulse width of 1 msec and a pulse interval of 16.6 msec is sequentially applied to the row-directional wirings 52 (Dy1 to Dym) each time for 60 seconds. Subsequently, by repeatedly executing the similar operation with respect to other column-directional wirings 53 (Dx2 to Dxn), the pulse voltage of 19V is applied to all of the electron-emitting devices, thereby driving the devices. The device current (If) flowing in each electron-emitting device at this time is measured, the voltage of 1 kV is applied to the anode electrode, and the emission current (Ie) is measured. An average value of electron-emitting efficiency (Ie/If) obtained from the measured device currents (If) and emission currents (Ie) is equal to 0.5% and it shows that excellent electron-emitting characteristics are obtained.

Embodiment 3

In a manner similar to the embodiment 2, the electron source substrate 71 obtained by executing the processes up to the activating step is formed.

After the electron source substrate 71 is fixed onto the rear plate 81, the face plate 86 is fixed 2 mm above the electron source substrate 71 through the supporting frame 82 and an exhaust pipe (not shown) and the envelope 88 is formed. A spacer (not shown) is arranged between the rear plate 81 and the face plate 86, thereby forming a structure which can withstand the atmospheric pressure. A getter (not shown) to keep the inside of the container in a high vacuum state is arranged in the envelope 88. Frit glass is used to joint the rear plate 81, the supporting frame 82, and the face plate 86 and they are seal-bonded by heating to 420° C. in an argon atmosphere.

Subsequently, after heating the whole panel to 250° C. while exhausting the atmosphere in the manufactured envelope 88 by the vacuum pump through the exhaust pipe, the temperature is dropped to the room temperature and the inside is set to a pressure of about $10^{-7}$ Pa. Thereafter, the exhaust pipe is heated by a gas burner, thereby melt-bonding it and sealing the envelope 88. Finally, to maintain the pressure after the sealing, the getter is high-frequency-heated and a getter process is executed. The image display apparatus as shown in FIG. 8 is manufactured in this manner.

In the image display apparatus completed as mentioned above, the preliminary driving is executed in a manner similar to the embodiment 2 and the device current, the emission current, and a non-selection current are measured in a manner similar to the embodiment 2, so that characteristics similar to those in the embodiment 2 are obtained.

Subsequently, while applying an information signal to the column-directional wirings 53 and a scanning signal to the row-directional wirings 52, the electron-emitting devices are sequentially driven. At this time, a pulse voltage of +7.5V is used for the information signal and a pulse voltage of −11.5V is used for the scanning signal. Also by applying the voltage of 10 kV to the metal back 85 through the high-voltage terminal 87, the emission electron is made to collide with the phosphor film 84 so as to be excited and emit the light, thereby displaying an image. The electron-emitting efficiency at an anode voltage of 10 kV is equal to a high value of 5% and the bright image can be displayed. A luminance deterioration is measured after driving the panel for 1000 hours, so that it has been found that a change ratio is equal to 5% or less.

Embodiment 4

In a manner similar to steps (a) to (f) in the embodiment 1, electron-emitting devices are formed on the substrate and the processes up to the forming step are executed. Subsequently, the following steps are executed.

Step (g)

The inside of the vacuum container is exhausted by the vacuum pump. When the pressure in the container reaches $2\times10^{-5}$ Pa, trinitrile is introduced into the vacuum container through the slow leakage valve and the pressure of $6\times10^{-4}$ Pa is maintained.

After that, as shown in FIG. 4, the column-directional wirings 53 (Dx1 to Dxn) are connected to the ground level in common through the terminals out of the container, the pulse voltages are sequentially applied to the row-directional wirings 52 (Dy1 to Dym), and the activation operation is executed.

As for the pulse voltages in this instance, the pulse voltages of the both polarities shown in FIG. 2 are used. The pulse voltages are applied under the following conditions: V1=−23V, V2=+21V, T1=0.01 msec, T2=0.01 msec, T3=0.1 msec, and T4=2.3 msec.

In this manner, the pulse voltages are applied for 10 minutes and the activation is finished.

The electron source substrate after the activating step is extracted from the vacuum container and five arbitrary devices are observed with the SEM. The structure of an arbitrary electron-emitting region is sliced by using the FIB working technique in order to observe a cross section. Thus, it has been found that most of the sliced cross sections have the structure shown in the schematic diagrams of FIGS. 1A and 1B, the groove portion 6 exists obliquely, and the deepest portion of the groove portion 6 is located under the Pd thin film.

Step (h)

The electron source substrate is put into the vacuum container again. While exhausting the inside of the vacuum container, the electron source substrate is heated at 300° C. and the vacuum container is heated at 200° C. for 10 hours, and the stabilization operation is executed.

With respect to the electron source formed as mentioned above, electron-emitting characteristics are evaluated in this vacuum container. The voltage is applied to the electron-emitting device through the terminals out of the container and the device current (If) flowing in the electron-emitting device at this time is measured. The anode electrode is attached 2 mm above the electron source substrate and the voltage is applied to the anode electrode. The emission current (Ie) emitted from the electron-emitting device is measured. The pressure in the vacuum exhauster at the time of measuring the electron-emitting characteristics is equal to $2\times10^{-8}$ Pa or less.

First, as preliminary driving, one (Dx1) of the column-directional wirings 53 is selected and the pulse voltage of +7.5V having a pulse width of 0.01 msec and a pulse interval of 16.6 msec is applied. Synchronously with it, the pulse voltage of −15V having a pulse width of 1 msec and a pulse interval of 16.6 msec is sequentially applied to the row-directional wirings 52 (Dy1 to Dym) by 10 pulses at a time. Subsequently, by repeatedly executing the similar operation with respect to other column-directional wirings 53 (Dx2 to Dxn), the pulse voltage of 22.5V is applied to all of the electron-emitting devices by 1000 pulses at a time. At this time, unselected wirings are connected to the ground level.

Subsequently, one (Dx1) of the column-directional wirings 53 is similarly selected and the pulse voltage of +7.5V having a pulse width of 1 msec and a pulse interval of 16.6 msec is applied. Synchronously with it, the pulse voltage of −11.5V having a pulse width of 0.1 msec and a pulse interval of 16.6 msec is sequentially applied to the row-directional wirings 52 (Dy1 to Dym) each time for 60 seconds. Subsequently, by repeatedly executing the similar operation with respect to other column-directional wirings 53 (Dx2 to Dxn), the pulse voltage of 19V is applied to all of the electron-emitting devices, thereby driving the devices. The device current (If) flowing in each electron-emitting device at this time is measured, the voltage of 1 kV is applied to the anode electrode, and the emission current (Ie) is measured. An average value of electron-emitting efficiency (Ie/If) obtained from the measured device currents (If) and emission currents (Ie) is equal to 0.6% and it shows that excellent electron-emitting characteristics are obtained.

Embodiment 5

In a manner similar to the embodiment 4, the electron source substrate 71 obtained by executing the processes up to the activating step is formed.

After the electron source substrate 71 is fixed onto the rear plate 81, the face plate 86 is fixed 2 mm above the electron source substrate 71 through the supporting frame 82 and the exhaust pipe (not shown) and the envelope 88 is formed. The spacer (not shown) is arranged between the rear plate 81 and the face plate 86, thereby forming the structure which can withstand the atmospheric pressure. The getter (not shown) to keep the inside of the container in a high vacuum state is arranged in the envelope 88. The frit glass is used to joint the rear plate 81, the supporting frame 82, and the face plate 86 and they are seal-bonded by heating to 420° C. in the vacuum atmosphere.

Subsequently, after heating the whole panel to 250° C. while exhausting the atmosphere in the manufactured envelope 88 by the vacuum pump through the exhaust pipe, the temperature is dropped to the room temperature and the inside is set to a pressure of about $10^{-7}$ Pa. Thereafter, the exhaust pipe is heated by the gas burner, thereby melt-bonding it and sealing the envelope 88. Finally, to maintain the pressure after the sealing, the getter is high-frequency heated and the getter process is executed. The image display apparatus as shown in FIG. 8 is manufactured in this manner.

In the image display apparatus completed as mentioned above, the preliminary driving is executed in a manner similar to the embodiment 2 and the device current, the emission current, and a non-selection current are measured in a manner similar to the embodiment 2, so that characteristics similar to those in the embodiment 2 are obtained.

Subsequently, while applying the information signal to the column-directional wirings 53 and the scanning signal to the row-directional wirings 52, the electron-emitting devices are sequentially driven. At this time, the pulse voltage of +7.5V is used for the information signal and the pulse voltage of −11.5V is used for the scanning signal. Also by applying the voltage of 10 kV to the metal back 85 through the high-voltage terminal 87, the emission electron is made to collide with the phosphor film 84 so as to be excited and emit the light, thereby displaying an image. The electron-emitting efficiency at the anode voltage of 10 kV is equal to a high value of 4% and the bright image can be displayed. A luminance deterioration is measured after driving the panel for 800 hours, so that it has been found that a change ratio is equal to 5% or less.

Embodiment 6

In a manner similar to steps (a) to (f) in the embodiment 1, electron-emitting devices are formed on the substrate and the processes up to the forming step are executed. Subsequently, the following steps are executed.

Step (g)

The inside of the vacuum container is exhausted by the vacuum pump. When the pressure in the container reaches $2\times10^{-5}$ Pa, trinitrile is introduced into the vacuum container through the slow leakage valve and the pressure of $6\times10^{-4}$ Pa is maintained.

After that, as shown in FIG. 4, the column-directional wirings 53 (Dx1 to Dxn) are connected to the ground level in common through the terminals out of the container, the pulse voltages are sequentially applied to the row-directional wirings 52 (Dy1 to Dym), and the activation operation is executed.

As for the pulse voltages in this instance, the pulse voltages of the both polarities shown in FIG. 2 are used. The pulse voltages are applied under the following conditions: V1=−23V, V2=+21V, T1=0.01 msec, T2=0.01 msec, T3=0.1 msec, and T4=0.01 msec.

In this manner, the pulse voltages are applied for 1 minute and the activation is finished.

The electron source substrate after the activating step is extracted from the vacuum container and five arbitrary devices are observed with the SEM. The structure of an arbitrary electron-emitting region is sliced by using the FIB working technique in order to observe a cross section. Thus, it has been found that most of the sliced cross sections have the structure shown in the schematic diagrams of FIGS. 1A and 1B, the groove portion 6 exists obliquely, and the deepest portion of the groove portion 6 is located under the Pd thin film.

Step (h)

The electron source substrate is put into the vacuum container again. While exhausting the inside of the vacuum container, the electron source substrate is heated at 300° C. and the vacuum container is heated at 200° C. for 10 hours, and the stabilization operation is executed.

With respect to the electron source formed as mentioned above, electron-emitting characteristics are evaluated in this vacuum container. The voltage is applied to the electron-emitting device through the terminals out of the container and the device current (If) flowing in the electron-emitting device at this time is measured. The anode electrode is attached 2 mm above the electron source substrate and the voltage is applied to the anode electrode. The emission current (Ie) emitted from the electron-emitting device is measured. The pressure in the vacuum exhauster at the time of measuring the electron-emitting characteristics is equal to $2\times10^{-8}$ Pa or less.

First, as preliminary driving, one (Dx1) of the column-directional wirings 53 is selected and the pulse voltage of +7.5V having a pulse width of 0.01 msec and a pulse interval of 16.6 msec is applied. Synchronously with it, the pulse voltage of −15V having a pulse width of 1 msec and a pulse interval of 16.6 msec is sequentially applied to the row-directional wirings 52 (Dy1 to Dym) by 10 pulses at a time. Subsequently, by repeatedly executing the similar operation with respect to other column-directional wirings 53 (Dx2 to Dxn), the pulse voltage of 22.5V is applied to all of the electron-emitting devices by 100 pulses at a time. At this time, unselected wirings are connected to the ground level.

Subsequently, one (Dx1) of the column-directional wirings 53 is similarly selected and the pulse voltage of +7.5V having a pulse width of 1 msec and a pulse interval of 16.6 msec is applied. Synchronously with it, the pulse voltage of −11.5V having a pulse width of 0.1 msec and a pulse interval of 16.6 msec is sequentially applied to the row-directional wirings 52 (Dy1 to Dym) each time for 60 seconds. Subsequently, by repeatedly executing the similar operation with respect to other column-directional wirings 53 (Dx2 to Dxn), the pulse voltage of 19V is applied to all of the electron-emitting devices, thereby driving the devices. At this time, the device current (If) flowing in each electron-emitting device is measured, the voltage of 1 kV is applied to the anode electrode, and the emission current (Ie) is measured. An average value of electron-emitting efficiency (Ie/If) obtained from the measured device currents (If) and emission currents (Ie) is equal to 0.5% and it shows that excellent electron-emitting characteristics are obtained.

Embodiment 7

In a manner similar to the embodiment 4, the electron source substrate 71 obtained by executing the processes up to the activating step is formed.

Subsequently, after the electron source substrate 71 is fixed onto the rear plate 81, the face plate 86 is fixed 2 mm above the electron source substrate 71 through the supporting frame 82 and the exhaust pipe (not shown) and the envelope 88 is formed. The spacer (not shown) is arranged between the rear plate 81 and the face plate 86, thereby forming the structure which can withstand the atmospheric pressure. The getter (not shown) to keep the inside of the container in a high vacuum state is arranged in the envelope 88. The frit glass is used to joint the rear plate 81, the supporting frame 82, and the face plate 86 and they are seal-bonded by heating to 420° C. in the vacuum atmosphere.

Subsequently, after heating the whole panel to 250° C. while exhausting the atmosphere in the manufactured envelope 88 by the vacuum pump through the exhaust pipe, the temperature is dropped to the room temperature and the inside is set to a pressure of about $10^{-7}$ Pa. Thereafter, the exhaust pipe is heated by the gas burner, thereby melt-bonding it and sealing the envelope 88. Finally, to maintain the pressure after the sealing, the getter is high-frequency heated and the getter process is executed. The image display apparatus as shown in FIG. 8 is manufactured in this manner.

In the image display apparatus completed as mentioned above, the preliminary driving is executed in a manner similar to the embodiment 2 and the device current, the emission current, and a non-selection current are measured in a manner similar to the embodiment 2, so that characteristics similar to those in the embodiment 2 are obtained.

Subsequently, while applying the information signal to the column-directional wirings 53 and the scanning signal to the row-directional wirings 52, the electron-emitting devices are sequentially driven. At this time, the pulse voltage of +7.5V is used for the information signal and the pulse voltage of −11.5V is used for the scanning signal. Also by applying the voltage of 10 kV to the metal back 85 through the high-voltage terminal 87, the emission electron is made to collide with the phosphor film 84 so as to be excited and emit the light, thereby displaying an image. The electron-emitting efficiency at the anode voltage of 10 kV is equal to a high value of 4% and the bright image can be displayed. A luminance deterioration is measured after driving the panel for 1000 hours, so that it has been found that a change ratio is equal to 5% or less.

This application claims priority from Japanese Patent Application No. 2004-127646 filed Apr. 23, 2004, which is hereby incorporated by reference herein.

What is claimed is:

1. An electron-emitting device having a pair of electroconductors arranged on a substrate with a gap wherein a top of one of said pair of electroconductors is higher than that of the other one of said pair of electroconductors and a groove extending obliquely from said gap toward a position under a surface of said substrate is formed, and wherein a distance between said position and said one electroconductor is shorter than a distance between said position and the other one of said pair of electroconductors.

2. A device according to claim 1, wherein a deepest portion of said groove from the surface of said substrate is located under a region where said one electroconductor comes into contact with said substrate.

3. A device according to claim 1, wherein said pair of electroconductors are made of a material containing carbon as a main component.

4. A device according to claim 1, wherein said pair of electroconductors include a first electroconductor made of a material containing metal as a main component, and a second electroconductor which covers said first electroconductor and is made of a material containing carbon as a main component.

5. A device according to claim 1, wherein said one electroconductor comprises a carbon film and an electroconductive thin film, a distance between the carbon film and the other electroconductor is shorter than a distance between the electroconductive thin film and the other electroconductor, and a deepest portion of said groove from the surface of said substrate is located under said electroconductive thin film.

6. An electron source having a plurality of electron-emitting devices on the substrate, wherein each electron-emitting device is the electron-emitting device according to claim 1.

7. An image display apparatus comprising an electron source having a plurality of electron-emitting devices on a substrate, and phosphor members which emit light by electrons emitted from said electron-emitting devices, wherein said electron source is the electron source according to claim 6.

8. An electron-emitting device having a pair of electroconductors arranged on a substrate with a gap, each electroconductor comprising an electroconductive film and a carbon film which is arranged on said electroconductive film, wherein a top of one of said pair of electroconductors is higher than that of the other one of said pair of electroconductors, and a groove, extending from said gap to a position under a region where the electroconductive film of said one electroconductor contacts with said substrate, is formed on said substrate.

9. An electron-emitting device comprising a substrate and, on a surface of the substrate, a pair of electroconductive films arranged with a first gap and a pair of carbon films arranged, on an area of the first gap and the electroconductive films, with a second gap narrower than the first gap, wherein a top of one of said pair of carbon films is higher than that of the other of said pair of carbon films and said substrate has a groove along said first gap, the groove extending from the first gap to a region beneath said electroconductive film on which said one carbon film is arranged.

* * * * *

UNITED STATES PATENT AND TRADEMARK OFFICE

CERTIFICATE OF CORRECTION

PATENT NO. : 7,230,372 B2
APPLICATION NO. : 11/106636
DATED : June 12, 2007
INVENTOR(S) : Keisuke Yamamoto et al.

It is certified that error appears in the above-identified patent and that said Letters Patent is hereby corrected as shown below:

ON THE TITLE PAGE [57]:

Line 6, “is come” should read --comes--.

COLUMN 1:

Line 29, “cross sectional” should read --cross-sectional--;
Line 35, “103, thereafter,” should read --103. Thereafter,--; and
Line 61, “ductor is” should read --ductor has--.

COLUMN 3:

Line 1, “ductor is” should read --ductor has-- and “substrate” should read --substrate and--.

COLUMN 4:

Line 38, “cross sectional” should read --cross-sectional--.

COLUMN 5:

Line 62, “applied are” should read --applied is--.

COLUMN 6:

Line 33, “satisfies” should read --satisfy--;
Line 47, “both of” should read --both--;
Line 60, “of” should be deleted;
Line 62, “films 5 are” should read --film 5 is--; and
Line 63, “films 4,” should read --film 4--.

COLUMN 7:

Line 12, “electroconductor is” should read --electroconductor has--; and
Line 17, “electroconductor is” should read --electroconductor has--.

COLUMN 9:

Line 65, “sw1 to swm” should read --Sw1 to Swm--.

UNITED STATES PATENT AND TRADEMARK OFFICE

CERTIFICATE OF CORRECTION

PATENT NO. : 7,230,372 B2
APPLICATION NO. : 11/106636
DATED : June 12, 2007
INVENTOR(S) : Keisuke Yamamoto et al.

It is certified that error appears in the above-identified patent and that said Letters Patent is hereby corrected as shown below:

COLUMN 12:

Line 55, “of the” should read --of--.

COLUMN 14:

Line 8, “of the” should read --of--.

COLUMN 18:

Line 8, “of the” should read --of--.

COLUMN 20:

Line 16, “include” should read --includes--.

Signed and Sealed this

Twenty-ninth Day of April, 2008

JON W. DUDAS
*Director of the United States Patent and Trademark Office*